US008693909B2

(12) United States Patent
Tanaka et al.

(10) Patent No.: US 8,693,909 B2
(45) Date of Patent: Apr. 8, 2014

(54) IMAGE FORMING METHOD AND IMAGE FORMING DEVICE FOR DETECTING TRANSFERRED IMAGE TRANSFERRED TO TRANSFER BELT

(75) Inventors: Hiroshi Tanaka, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 824 days.

(21) Appl. No.: 12/896,146

(22) Filed: Oct. 1, 2010

(65) Prior Publication Data

US 2011/0116821 A1 May 19, 2011

(30) Foreign Application Priority Data

Nov. 17, 2009 (JP) ..... 2009-261886

(51) Int. Cl.
*G03G 15/00* (2006.01)

(52) U.S. Cl.
USPC ..... 399/66

(58) Field of Classification Search
USPC ..... 399/66, 101, 304, 313; 101/489; 430/117.4
See application file for complete search history.

(56) References Cited

U.S. PATENT DOCUMENTS

| | | | | |
|---|---|---|---|---|
| 7,062,202 | B2 | 6/2006 | Kitazawa et al. | |
| 7,457,568 | B2 | 11/2008 | Kitazawa et al. | |
| 7,672,618 | B2 | 3/2010 | Kitazawa et al. | |
| 2009/0232536 | A1 * | 9/2009 | Nishimura et al. | 399/101 |
| 2011/0008079 | A1 * | 1/2011 | Kamijo et al. | 399/304 |

FOREIGN PATENT DOCUMENTS

| | | | |
|---|---|---|---|
| JP | 9-114257 | A | 5/1997 |
| JP | 2003-241515 | A | 8/2003 |
| JP | 2004-117666 | A | 4/2004 |
| JP | 2009-139473 | A | 6/2009 |

* cited by examiner

*Primary Examiner* — Walter L Lindsay, Jr.
*Assistant Examiner* — Ruth Labombard
(74) *Attorney, Agent, or Firm* — Global IP Counselors, LLP

(57) ABSTRACT

An image forming method includes rotating a transfer roller which forms a transfer nip by coming in contact with a transfer belt and has a concaved portion wider than the transfer nip in a rotation direction, such that the concaved portion comes to a position of facing the transfer belt, stopping rotation of the transfer roller at a position where the transfer belt faces the concaved portion of the transfer roller and the transfer belt and the transfer roller are spaced apart from each other, moving the transfer belt while the transfer roller is stopped and transferring an image formed on an image carrier to the transfer belt, and detecting the transferred image by a detection portion.

6 Claims, 21 Drawing Sheets

IMAGE FORMING METHOD AND IMAGE FORMING DEVICE FOR DETECTING TRANSFERRED IMAGE TRANSFERRED TO TRANSFER BELT

BACKGROUND

1. Technical Field

The present invention relates to an image forming method and an image forming device, which form images by transferring toner images developed by a development device to a transfer material such as a recording paper and fixing the toner images on the transfer material.

2. Related Art

There have been proposed a large number of image forming devices which develop latent images by using a liquid developer with a high viscosity in which toners of a solid component are dispersed in a liquid solvent, and allow electrostatic latent images to be visualized. Developers usable in the image forming devices are formed by suspending solid contents (toner particles) in an organic solvent (carrier liquid) with a high viscosity which is constituted by a silicon oil, a mineral oil, an edible oil, or the like and has an electrical insulation property, and the toner particle has a particle diameter of about 1 μm and is extremely fine. Of them, wet type image forming devices which employ the fine toner particles enable a higher image quality than dry type image forming devices which employ powder toner particles with a particle diameter of about 7 μm.

In the related art, an electrophotographic type image forming device using a liquid developer forms images by transferring toner images formed on a development portion to a transfer member and then by secondarily transferring the transferred toner images to a transfer material such as recording paper or the like. The transfer member to which the toner images are transferred from the development portion may use a belt type or a roller type, and a surface of the transfer member is used repeatedly several times. For this reason, the surface of the transfer member after the secondary transfer is cleaned by a cleaning portion which is provided to come in contact with the transfer member, in order to remove toner or the like remaining thereon after the transfer, and is prepared for forming of new images.

In the image forming device using such a liquid developer, if a state of the liquid developer varies during the development, there are variations in images which are finally transferred to a transfer material. For example, various kinds of conditions, such as concentration of toner particles in the liquid developer, or bias voltages from a photoconductor to a transfer member, or from the transfer member to a secondary transfer member, or the like, have influence on images on the transfer material. There have been proposed various kinds of image forming devices in which, in order to exclude the influence of the various conditions and to stably form images on the transfer material, a test image (patch image) is formed on the transfer material or the transfer member, the density of the test image or the like is detected using an optical system sensor or the like, and an adjustment processing for setting various kinds of conditions is performed.

As an image forming device which performs the adjustment processing using the test image, JP-A-9-114257 discloses an image forming device which forms a test image on a surface of a recording paper, detects the test image using a density detection sensor, and supplies toner to development liquid in a development liquid tank, based on a detected value. Also, JP-A-2004-117666 discloses an image forming device which forms a plurality of test images while varying a development bias, detects the density of the test images using a patch sensor, and obtains an appropriate concentration of toner in development liquid based on an image density of a test image formed under an image forming condition where the image density is saturated. In the image forming device disclosed in JP-A-2004-117666, as a place for detecting the image density of the formed test images, there are proposed not only photoconductors, but also an intermediate transfer roller, or a dedicated member for transferring the patch images.

As such, the image forming devices disclosed in JP-A-9-114257 and JP-A-2004-117666 can adjust a state of the liquid developer using the formed test images, thereby forming high quality images. In the image forming device disclosed in JP-A-9-114257, in order to form test images on a surface of a recording paper, a patch region is required to be formed on the recording paper. On the contrary, in the image forming device disclosed in JP-A-2004-117666, there is no need to form extra patch regions on the recording paper since the test images are formed on various constituent elements such as the photoconductors and the like which are used in the process of printing and detected. However, there is a problem in that if the test images formed on the various constituent elements remain in the image forming device, they contaminate the inside of the device and deteriorate quality of images to be formed. Therefore, the test images formed on the various constituent elements in the image forming device are required to be appropriately removed; however, there are no disclosures of removal of the test images, that is, cleaning.

SUMMARY

According to an aspect of the invention, there is provided an image forming method including rotating a transfer roller which forms a transfer nip by coming in contact with a transfer belt and has a concaved portion wider than the transfer nip in a rotation direction, such that the concaved portion comes to a position of facing the transfer belt; stopping rotation of the transfer roller at a position where the transfer belt faces the concaved portion of the transfer roller and the transfer belt and the transfer roller are spaced apart from each other; moving the transfer belt while the transfer roller is stopped, and transferring an image formed on an image carrier to the transfer belt; and detecting the transferred image by a detection portion.

In the image forming method, the image transferred to the transfer belt may be cleaned by a cleaning roller which comes in contact with the transfer belt and is applied with a bias, while the transfer roller is stopped.

According to an aspect of the invention, there is provided an image forming device including an image carrier that carries an image; a transfer belt to which an image carried on the image carrier is transferred; a transfer roller that forms a transfer nip by a circumferential surface coming in contact with the transfer belt and has a concaved portion wider than the transfer nip in a rotation direction in the circumferential surface; a controller that enables the transfer roller to stop rotating at a position where the concaved portion of the transfer roller faces the transfer belt and the transfer roller is spaced apart from the transfer belt, the transfer belt to be moved while the transfer roller stops rotating, and the image carried on the image carrier to be transferred to the transfer belt; and a detection portion that detects the image transferred to the transfer belt.

The image forming device may further include a cleaning portion that cleans the transfer belt, and the controller may enable the cleaning portion to clean the image transferred to the transfer belt while the transfer roller stops rotating.

The cleaning portion may be a cleaning roller that comes in contact with the transfer belt and is applied with a bias, and the controller may enable the cleaning roller to be applied with a bias while the transfer roller stops rotating.

The concaved portion of the transfer roller may be provided with a gripping portion which grips a transfer material.

As such, according to the image forming method and the image forming device, by rotating the transfer roller such that the concaved portion comes to a position of facing the transfer belt and by forming an image on the transfer belt in the state where the transfer belt and the transfer roller are spaced apart from each other, it is possible to prevent the transfer roller from being contaminated with the image formed on the transfer belt. In addition, by cleaning the transfer belt, it is possible to appropriately clean a test image.

Also, by installing the transfer material gripper in the concaved portion of the transfer roller, it is possible to install the transfer material gripper having a sufficient gripping force, to perform accurate positioning of a transfer material, and to prevent misalignment after gripping.

Also, by using the cleaning roller which is applied with application liquid as the cleaning portion for cleaning the transfer belt, it is possible to efficiently recover a test image on the transfer belt.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
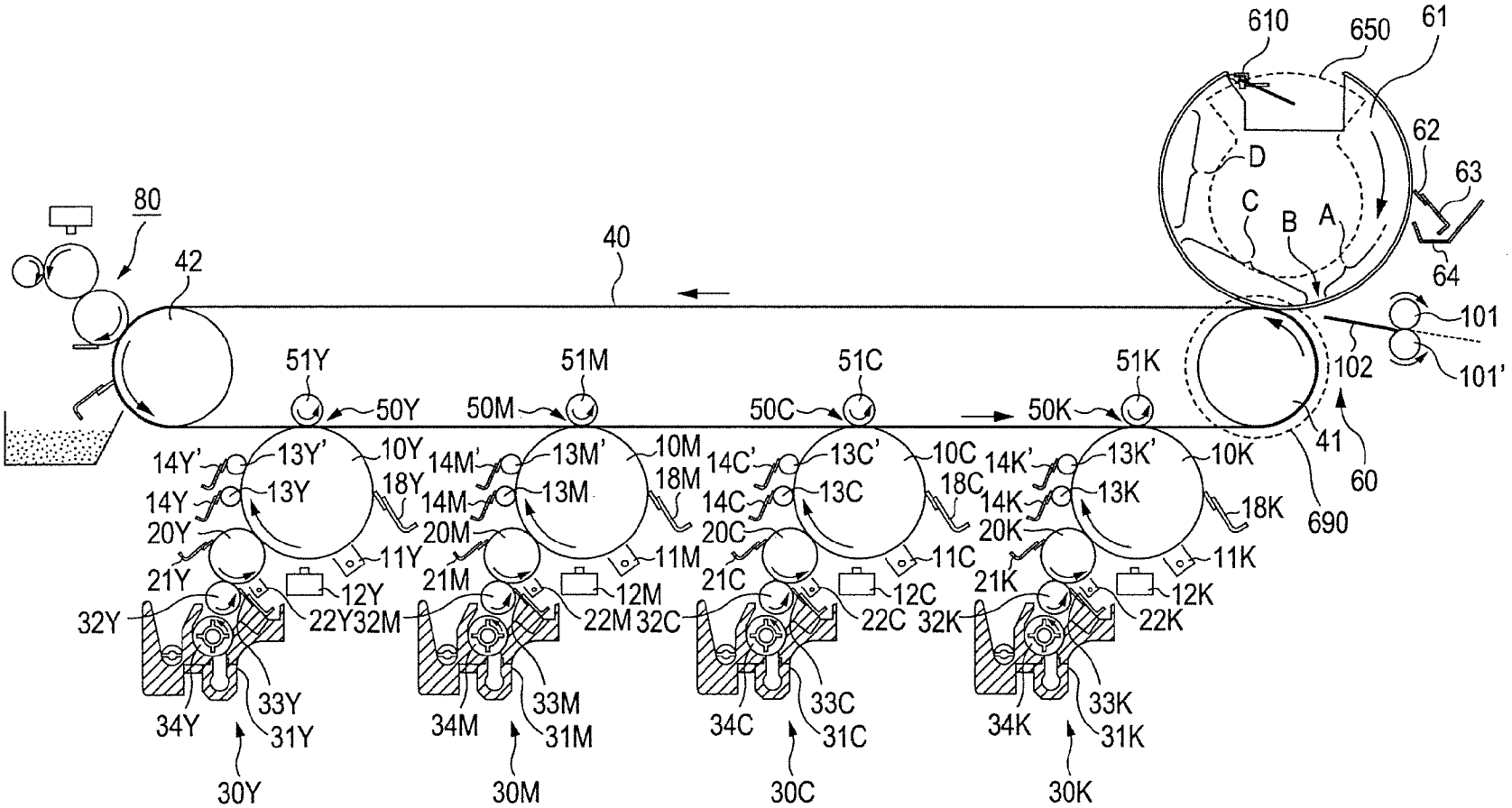
FIG. 1 is a diagram illustrating a main configuration of an image forming device.

FIG. 1 is a main configuration of an image forming device according to an embodiment of the invention. With respect to a transfer belt 40, as an image carrier or a transfer medium, which is positioned at a central portion of the image forming device, development devices 30Y, 30M, 30C and 30K as development portions are arranged in the lower side of the image forming device, and, constituent elements such as a secondary transfer unit 60 as a transfer portion, a fixing unit (not shown) and the like are arranged in the higher side of the image forming device.

Around photoconductors 10Y, 10M, 10C and 10K as latent image carriers, there are provided corona charging devices 11Y, 11M, 11C and 11K, exposure units 12Y, 12M, 12C and 12K, and the like, such as an LED array etc., in order to form images using toner. The corona charging devices 11Y, 11M, 11C and 11K charge the photoconductors 10Y, 10M, 10C and 10K in the same manner, an exposure is performed by the exposure units 12Y, 12M, 12C and 12K as exposure portions, based on input image signals, and electrostatic latent images are formed on the charged photoconductors 10Y, 10M, 10C and 10K.

The development devices 30Y, 30M, 30C and 30K substantially include development rollers 20Y, 20M, 20C and 20K which are developer carriers, developer reservoirs 31Y, 31M, 31C and 31K which store liquid developers of respective colors including yellow (Y), magenta (M), cyan (C), and black (K), and anilox rollers 32Y, 32M, 32C and 32K, as developer supply members which are applying rollers applying the liquid developers of the respective colors to the development rollers 20Y, 20M, 20C and 20K from the developer reservoirs 31Y, 31M, 31C and 31K. Thereby, the electrostatic latent images formed on the photoconductors 10Y, 10M, 10C and 10K are developed using the liquid developers of the respective colors.

Primary transfer portions 50Y, 50M, 50C and 50K transfer the images formed on the photoconductors 10Y, 10M, 10C and 10K to the transfer belt 40, via nip portions between the photoconductors 10Y, 10M, 10C and 10K and primary transfer backup rollers 51Y, 51M, 51C and 51K.

The transfer belt 40 is formed of an elastic member such as seamless rubber or the like, which hangs between a belt driving roller 41 and a tension roller 42, comes in contact with the primary transfer portions 50Y, 50M, 50C and 50K and the photoconductors 10Y, 10M, 10C and 10K, and is rotatably driven by the belt driving roller 41. In the primary transfer portions 50Y, 50M, 50C and 50K, the photoconductors 10Y, 10M, 10C and 10K are arranged opposite to the primary transfer backup rollers 51Y, 51M, 51C and 51K with the transfer belt 40 interposed therebetween. The developed toner images of the respective colors on the photoconductors 10Y, 10M, 100 and 10K are sequentially transferred onto the transfer belt 40 in an overlapping manner at contact positions with the photoconductors 10Y, 10M, 10C and 10K as transfer positions, thereby forming toner images of full colors.

The tension roller 42 allows the transfer belt 40 to hang thereon along with the belt driving roller 41 and the like. In a place where the transfer belt 40 hangs on the tension roller 42, a cleaning device 80 comes in contact therewith to clean remaining toner and carrier on the transfer belt 40.

The secondary transfer unit 60 is provided with a secondary transfer roller 61 which is a means of transferring the toner images to a transfer medium, and the like. The secondary transfer roller 61 rotates in the direction indicated by the arrow so as to be moved along the movement direction of the transfer belt 40. In addition, the secondary transfer roller 61 is applied with a transfer bias and transfers, at a transfer nip, the toner images on the transfer belt 40 to a transfer material such as paper, film, fabric, or the like which is transported in a transfer material transport path L. Further, the secondary transfer unit 60 has a secondary transfer roller cleaning blade 62 which cleans the secondary transfer roller 61, a blade support member 63, and the like.

A transfer material transport device (not shown) is arranged downstream of the secondary transfer unit 60 in the transfer material transport path L and transports the transfer material to a fixing unit (not shown). The fixing unit welds the toner images of a single color or full colors, which have been transferred onto a transfer material such as paper or the like, and fixes them to the transfer material such as paper or the like.

A transfer material is supplied to the image forming device by a paper feeding device (not shown). The transfer material set in the paper feeding device is fed to the transfer material transport path L at a predetermined timing for each sheet. In the transfer material transport path L, the transfer material is transported to the secondary transfer position using gate rollers 101 and 101' as a transfer material transfer portion and a transfer material guide 102, where toner images of a single color or toner images of full colors formed on the transfer belt 40 are transferred to the transfer material.

The transfer material to which the toner images are secondarily transferred is transported to the fixing unit by the transfer material transport device, as described above. The fixing unit includes a heating roller (not shown) and a biasing roller (not shown) which is biased to the heating roller side at a predetermined pressure, and the transfer material is inserted into a nip therebetween. Thereby, the toner images of a single color or full colors transferred on the transfer material are welded and fixed to the transfer material such as paper or the like.

Here, the peripherals of the photoconductors of the respective colors and the development devices have the same configurations, and thus the development device 30 will now be described by exemplifying the peripherals of the photoconductor of yellow (Y) and the development device 30Y.

As peripherals of the photoconductor, there are provided along the rotation direction of the outer circumference of the photoconductor 10Y with respect to the corona charging device 11Y, the exposure unit 12Y, the development roller 20Y of the development device 30Y, a first photoconductor squeeze roller 13Y, a second photoconductor squeeze roller 13Y', the primary transfer portion 50Y, a static eliminator (not shown) eliminating a potential of the photoconductor 10Y, and a photoconductor cleaning blade 18Y. Also, in an image forming process, in an order from the corona charging device 11Y to the photoconductor cleaning blade 18Y, constituent elements arranged at a further forward position are defined to be positioned upstream as compared with constituent elements arranged at a further backward position.

The photoconductor 10Y is a photoconductive drum which is constituted by a cylindrical member where a photoconductive layer such as an amorphous silicon photoconductor or the like is formed on the outer circumferential surface, and rotates in the clockwise direction in FIG. 1. The corona charging device 11Y is arranged at the upstream side in the rotation direction of the photoconductor 10Y when seen from the nip portion between the photoconductor 10Y and the development roller 20Y, and is applied with a voltage from a power supply (not shown) to corona-charge the photoconductor 10Y. The exposure unit 12Y is arranged downstream when seen from the corona charging device 11Y and upstream when seen from the nip portion between the photoconductor 10Y and the development roller 20Y in the rotation direction of the photoconductor 10Y, irradiates light to the photoconductor 10Y charged by the corona charging device 11Y, and enables a latent image to be formed on the photoconductor 10Y.

In addition, the development device 30Y has the development roller 20Y carrying the above-described liquid developer, the anilox roller 32Y which is an applying roller for applying the liquid developer to the development roller 20Y, a limitation blade 33Y limiting the amount of the liquid developer applied to the development roller 20Y, an auger 34Y which supplies the liquid developer to the anilox roller 32Y while stirring and transporting the liquid developer, a compaction corona generator 22Y which makes the liquid developer carried to the development roller 20Y lie in a compacted state, a development roller cleaning blade 21Y which cleans the development roller 20Y, and the developer reservoir 31Y which stores the liquid developer where toner is dispersed in a carrier at a proportion by weight of roughly 20%.

The liquid developer contained in the developer reservoir 31Y is a non-volatile liquid developer having high concentration, high viscosity, and non-volatility at a room temperature, not a liquid developer which typically uses Isopar (trademark: Exxon) as a carrier in the related art and has low concentration (ranging from 1 to 2 wt %), low viscosity, and volatility at room temperature. That is to say, in the liquid developer according to an embodiment of the invention, solid particles, having an average particle diameter of 1 μm in which coloring agents such as pigments or the like are dispersed in thermoplastic resin, are added in a liquid solvent such as an organic solvent, a silicon oil, a mineral oil, an edible oil, or the like along with a disperser. The liquid developer has the concentration of solid contents of about 20% and a high viscosity (HAAKE RheoStress Rs 600 is used, and the viscoelasticity is about 30 to 300 mPa·s in a shear velocity 1000(1/s) at 25° C.)

As described above, although the development device 30Y of the Y color has been described, the development devices 30M, 30C and 30K of the other colors have the same configuration as well. In addition, an arranging order and the number of members such as photoconductors 20, the development devices 30 or the like corresponding to the respective colors Y, M, C and K are not limited to those shown in FIG. 1, but they may be set arbitrarily. Further, a configuration of a single color is also possible.

Figure 2:
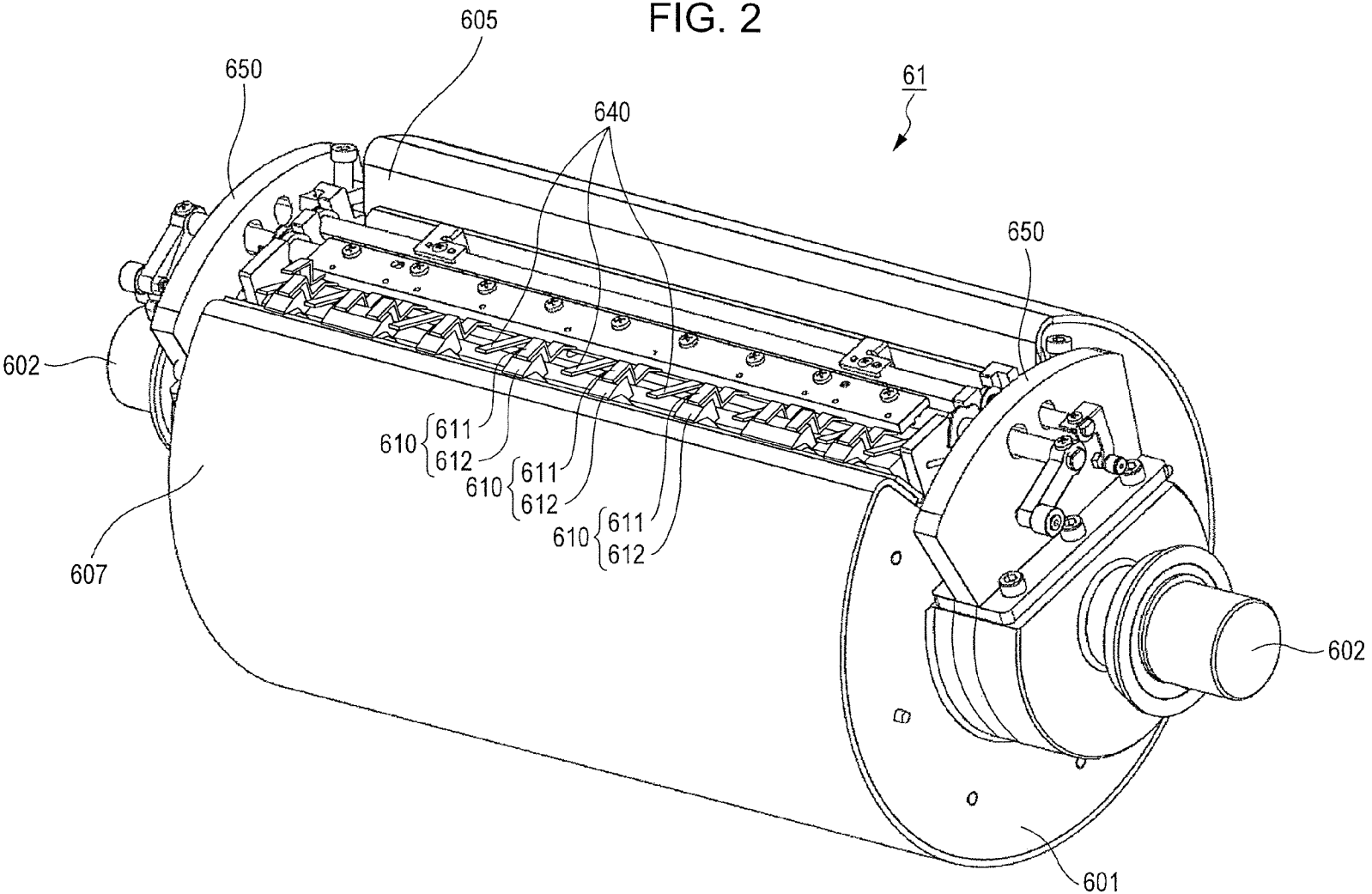
FIG. 2 is a perspective view of a secondary transfer roller.

Next, a configuration of the secondary transfer roller 61 will be described. FIG. 2 is a diagram illustrating the secondary transfer roller 61 according to an embodiment of the invention, and FIG. 3 is a sectional view of the secondary transfer roller 61.

Figure 3:
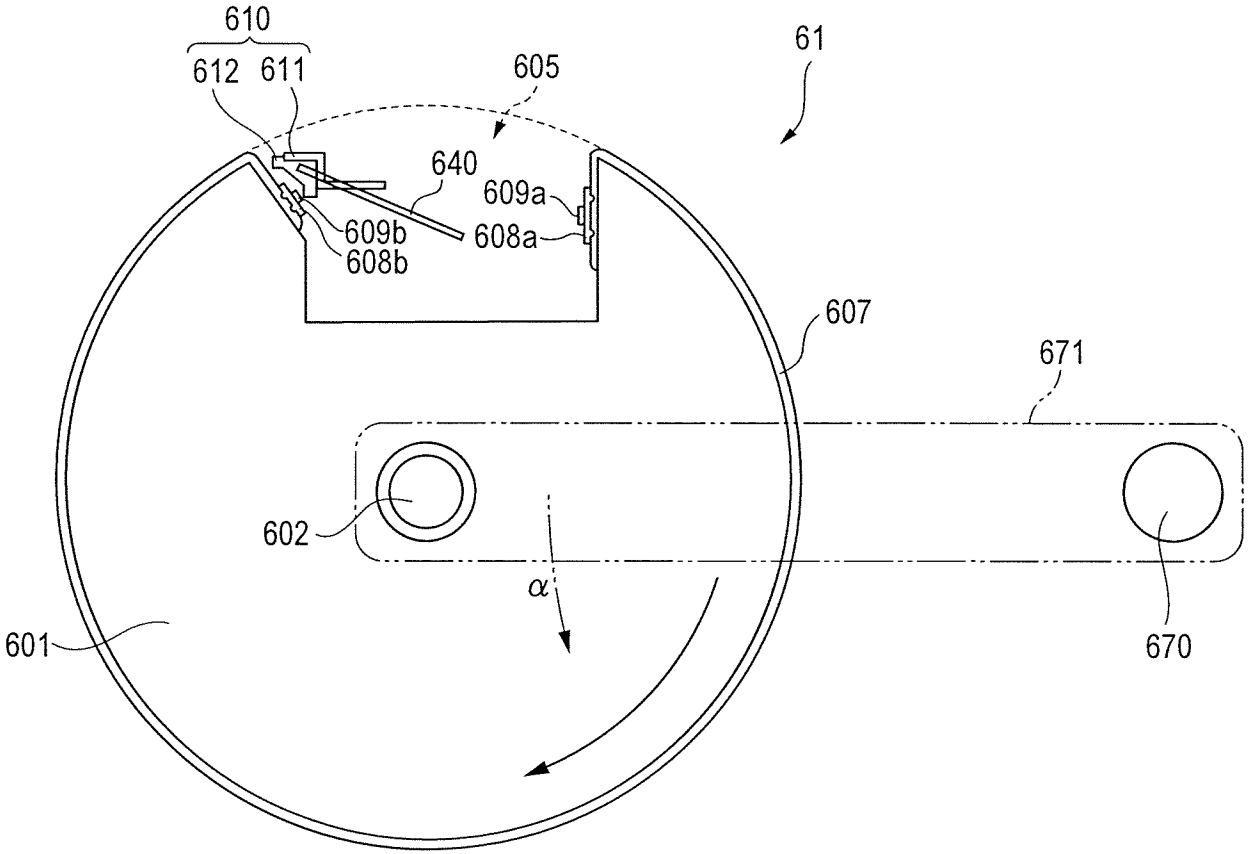
FIG. 3 is a sectional view of the secondary transfer roller.

In FIGS. 2 and 3, the reference numeral 601 denotes a roller base material, the reference numeral 602 denotes roller shaft portions, the reference numeral 605 denotes a concaved portion, the reference numeral 607 denotes an elastic member, the reference numeral 610 denotes a transfer material gripper, the reference numeral 611 denotes a gripping member, the reference numeral 612 denotes a gripping member receiving portion, the reference numeral 640 denotes a transfer material peeling member, and the reference numeral 650 denotes a contact member, respectively.

The roller shaft portions 602 are installed at both end portions of the roller base material 601 of the secondary transfer roller 61 which can be installed in a device main body side to rotate with respect to the roller shaft portions 602. The concaved portion 605 extending in the axial direction is provided in the roller base material 601, and the transfer material gripper 610 is provided in the concaved portion 605. The transfer material gripper 610 is a mechanism for gripping or releasing a transfer material.

The elastic member 607 which supports a transfer material is provided on the circumferential surface of the roller base material 601. The elastic member 607 is a member formed of a half-conductive elastic rubber layer having an electrical resistance component, and both ends thereof are fixed in the concaved portion 605 in a state of being wound on the roller base material 601. FIG. 3 shows a state where the elastic member 607 is fixed. One end of the elastic member 607 is fixed to the roller base material 601 by a fixing member 609*a* such as a screw or the like, along with a plate 608*a* which extends in the axial direction and comes in contact with the roller base material 601. The other end of the elastic member 607 is also reliably fixed to the roller base material 601 by a plate 608*b* and a fixing member 609*b*. In addition, the fixing of the elastic member 607 to the roller base material 601 is not limited thereto, but other methods may be used.

By winding the elastic member 607 around the transfer roller 61, it is possible to secure a wider secondary transfer nip formed between the transfer roller 61 and the transfer belt 40 and to increase transfer efficiency. In addition, by installing the fixing portions for fixing the elastic member 607 in the concaved portion 605 of the transfer roller 61, it is possible to easily change the elastic member 607 without need of fixing the elastic member 607 to the surface of the transfer roller 61.

In addition, the roller shaft portion 602 of the secondary transfer roller 61 is rotatably supported by a frame member 671. The frame member 671 rotates and oscillates with respect to a rotation support shaft portion 670 which is supported by the device main body, and is biased to the direction a indicated by the arrow by a biasing member (not shown). The secondary transfer roller 61 comes in contact with the belt driving roller 41 by a biasing force of the biasing member via the transfer belt 40 at a constant load.

As an outline, each of the transfer material grippers 610 includes a pair constituted by the gripping member 611 and the gripping member receiving portion 612 which are discretely provided in the roller axial direction, and a plurality of the transfer material peeling member 640 which is appropriately arranged between the pair in the roller axial direction. Each of the gripping members 611 is movable and operates to pinch a transfer material along with the gripping member receiving portion 612, thereby gripping the transfer material, or operates to open an interval between it and the gripping member receiving portion 612, thereby releasing the transfer material. Also, each of the transfer material peeling members 640 operates to push a transfer material, gripped by the gripping member 611 and the gripping member receiving portion 612, away from the secondary transfer roller 61 side.

The operation of the transfer material gripper 610 will be described in more detail with reference to FIGS. 4A to 4D. FIGS. 4A to 4D are diagrams of the respective constituent elements of the transfer material gripper 610 shown schematically when seen from the axial direction. FIG. 4A, FIG. 4B, FIG. 4C, and FIG. 4D respectively show operation states performed by the transfer material gripper 610 when the transfer material gripper 610 of the secondary transfer roller 61 reaches the positions marked with A, B, C, and D at the secondary transfer roller 61 in FIG. 1.

Figure 4A:
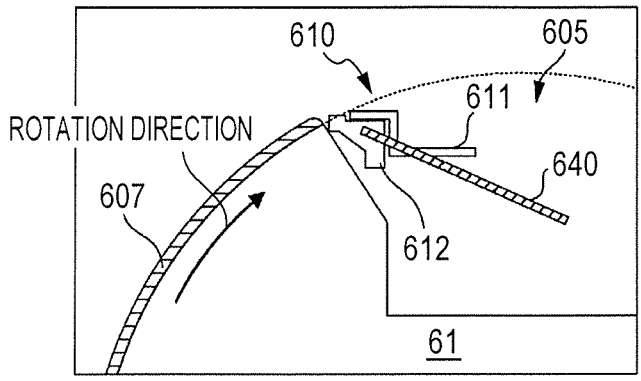
FIGS. 4A to 4D are a diagram illustrating an operation of a transfer material gripper of the secondary transfer roller.

FIG. 4A shows a state where the secondary transfer roller 61 rotates when the transfer material gripper 610 does not grip a transfer material. At this time, if the secondary transfer roller 61 is assumed to be, for example, a cylinder, the gripping member 611 or the transfer material peeling member 640 is settled at its outermost circumference. This shows a state where the transfer material gripper 610 is present in the range of A in FIG. 1 in the rotation procedure of the secondary transfer roller 61.

Figure 4B:
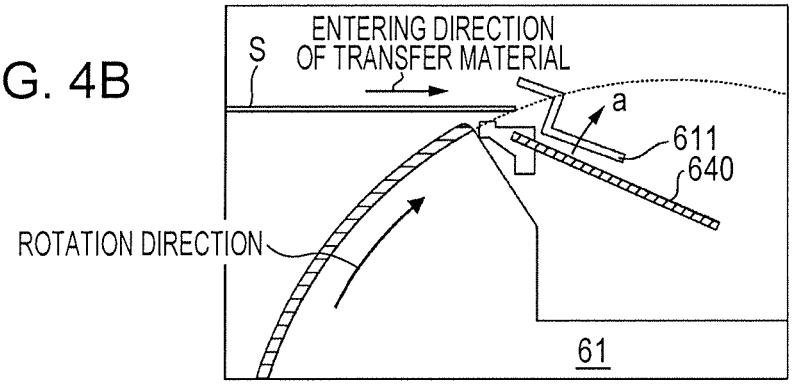

FIG. 4B shows the state where the gripping member 611 moves in the direction a to generate a predetermined space between it and the gripping member receiving portion 612, and the gripping member 611 is ready to pinch the transfer material S entering the space along with the gripping member receiving portion 612. This shows a state where the transfer material gripper 610 comes to the position B in FIG. 1 in the rotation procedure of the secondary transfer roller 61, and is ready to grip the transfer material entering along the transfer material guide 102 by the rotation of the gate rollers 101 and 101'.

Figure 4C:
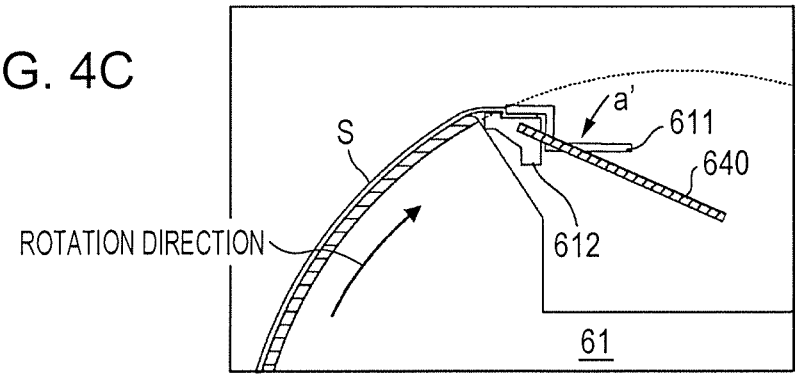

FIG. 4C shows a state where the gripping member 611 is moved to the direction a' and pinches the transfer material S having entered the space between it and the gripping member receiving portion 612. At this time, the transfer material S of which one end is pinched by the transfer material gripper 610 is wound by the secondary transfer roller 61 in accordance with the rotation of the secondary transfer roller 61 of the roller base material 601. In this way, since the transfer material S is gripped and fixed by the transfer material gripper 610 at the front portion where the transfer material enters the secondary transfer nip, the positioning of the transfer material S onto which toner images are transferred can be accurately performed. In the rotation procedure of the secondary transfer roller 61, the state shown in FIG. 4C is maintained when the transfer material gripper 610 is positioned in the range of C in FIG. 1.

Figure 4D:
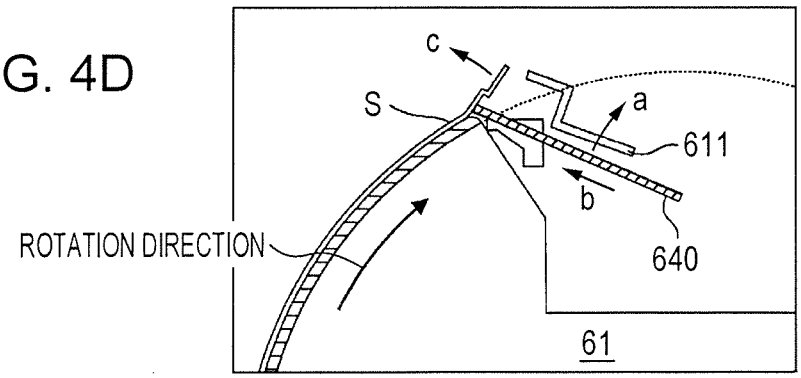

FIG. 4D shows a state where the gripping member 611 moves in the direction a to generate a predetermined space between it and the gripping member receiving portion 612 so as to release the transfer material S, and the transfer material peeling member 640 moves in the direction b to push the transfer material S away from the secondary transfer roller 61. In the rotation procedure of the secondary transfer roller 61, this operation state corresponds to a state where the transfer material gripper 610 comes to the position D in FIG. 1, and the transfer material S onto which toner images are transferred while passing through the secondary transfer nip is delivered to a subsequent transfer material transport process.

As described above, the transfer material gripper 610 grips the transfer material S before the transfer material S is inserted into the secondary transfer nip between the transfer belt 40 and the secondary transfer roller 61. Also, the transfer material gripper 610 is operated so as to release the gripped transfer material S after the transfer material S is inserted into the secondary transfer nip between the transfer belt 40 and the secondary transfer roller 61. The transfer material S having passed through the secondary transfer nip can be reliably guided to a next process by the transfer material gripper 610 being operated as shown in FIG. 4D so as to reliably separate the transfer material S from the secondary transfer roller 61.

In addition, generally, in the image forming process using liquid developers, there is a case where the transfer material S to which toner images are transferred at the secondary transfer nip is attached to either the secondary transfer roller 61 or the transfer belt 40 and thus is difficult to peel; however, the transfer material S can be reliably peeled from each constituent element by the operation shown in FIG. 4D using the transfer material gripper 610.

Figure 5:
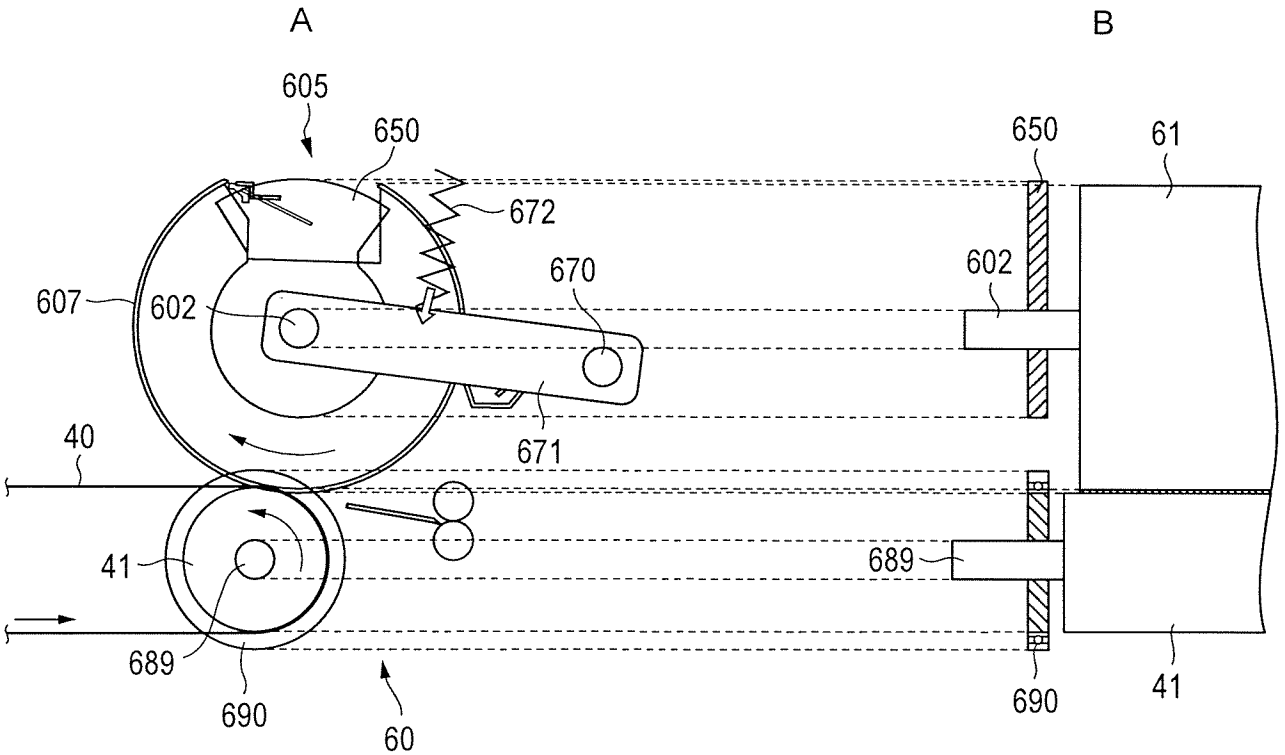
FIG. 5 is a diagram illustrating a state where the secondary transfer roller rotates.
Figure 6:
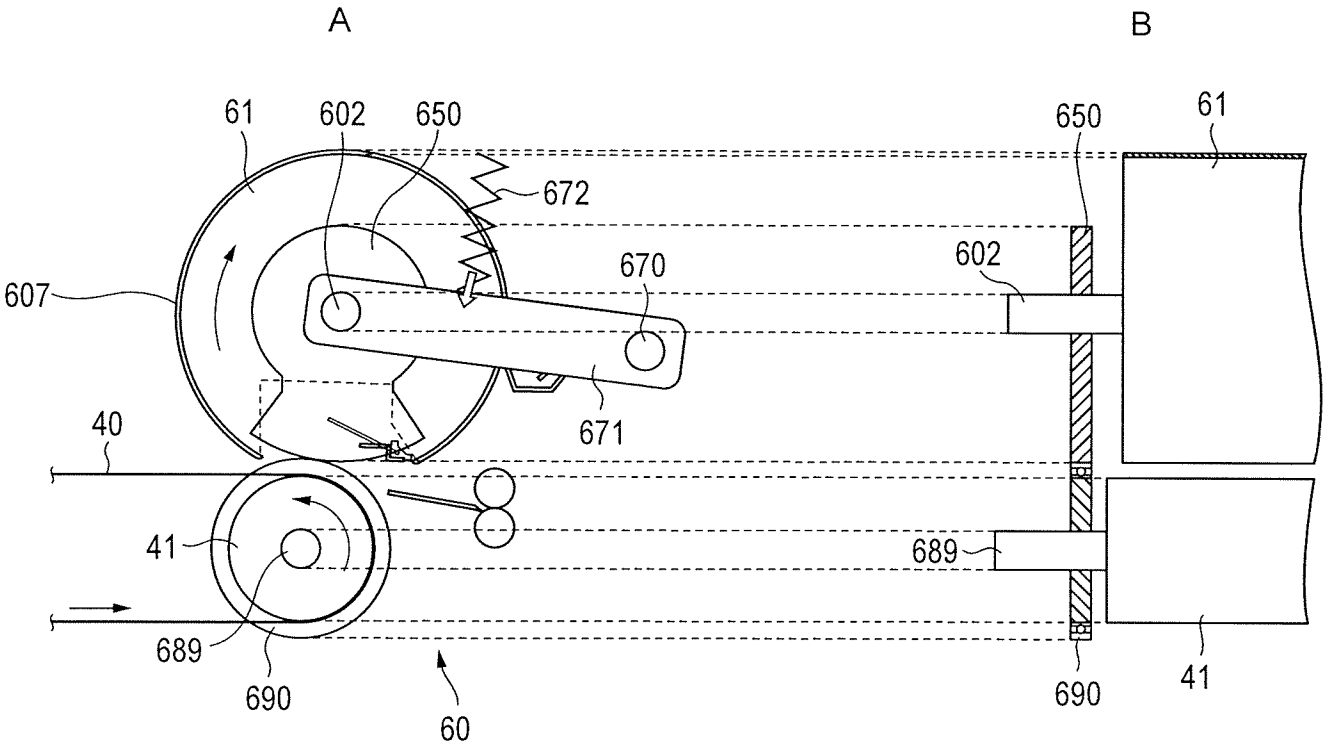
FIG. 6 is a diagram illustrating a state where the secondary transfer roller rotates (when the concaved portion faces the transfer belt).

Next, there will be description of a structure where the secondary transfer roller 61 provided in the concaved portion 605 applies a predetermined pressure to the secondary transfer nip and limits a position between the secondary transfer roller 61 and the belt driving roller 41. FIGS. 5 and 6 are diagrams illustrating an operation of the secondary transfer unit 60 in the image forming device according to the embodiment of the invention. A in both of the figures shows the secondary transfer unit 60 when seen from the side of the device, and B therein shows a schematic section of the secondary transfer unit 60. In FIGS. 5 and 6, the reference numeral 650 denotes the contact member, the reference numeral 670 denotes the rotation support shaft portion, the reference numeral 671 denotes the frame member, the reference numeral 672 denotes a biasing member, the reference numeral 689 denotes a roller shaft portion of the belt driving roller 41, and the reference numeral 690 denotes a support member, respectively.

In the secondary transfer unit 60, both ends of the roller shaft portion 602 of the secondary transfer roller 61 are rotatably installed to the frame member 671. In addition, the frame member 671 can rotate with respect to the rotation support shaft portion 670 and is biased to the direction indicated by the arrow in the figures due to the biasing member 672. By such a structure, the secondary transfer roller 61 can be biased to the belt driving roller 41 side to apply a predetermined pressure to the secondary transfer nip between the secondary transfer roller 61 and the belt driving roller 41. Due to the transfer pressure and the transfer bias at the secondary transfer nip, toner particles on the transfer belt 40 are efficiently transferred to the transfer material side at the secondary transfer nip.

The contact member 650 is provided in each end of the roller shaft portion 602 of the secondary transfer roller 61. The support member 690 is provided in each end of the roller shaft portion 689 of the belt driving roller 41 in order to correspond to the contact member 650. As shown in B of FIGS. 5 and 6, the contact member 650 and the support member 690 are installed to be arranged in order in the axial direction.

Figure 7:
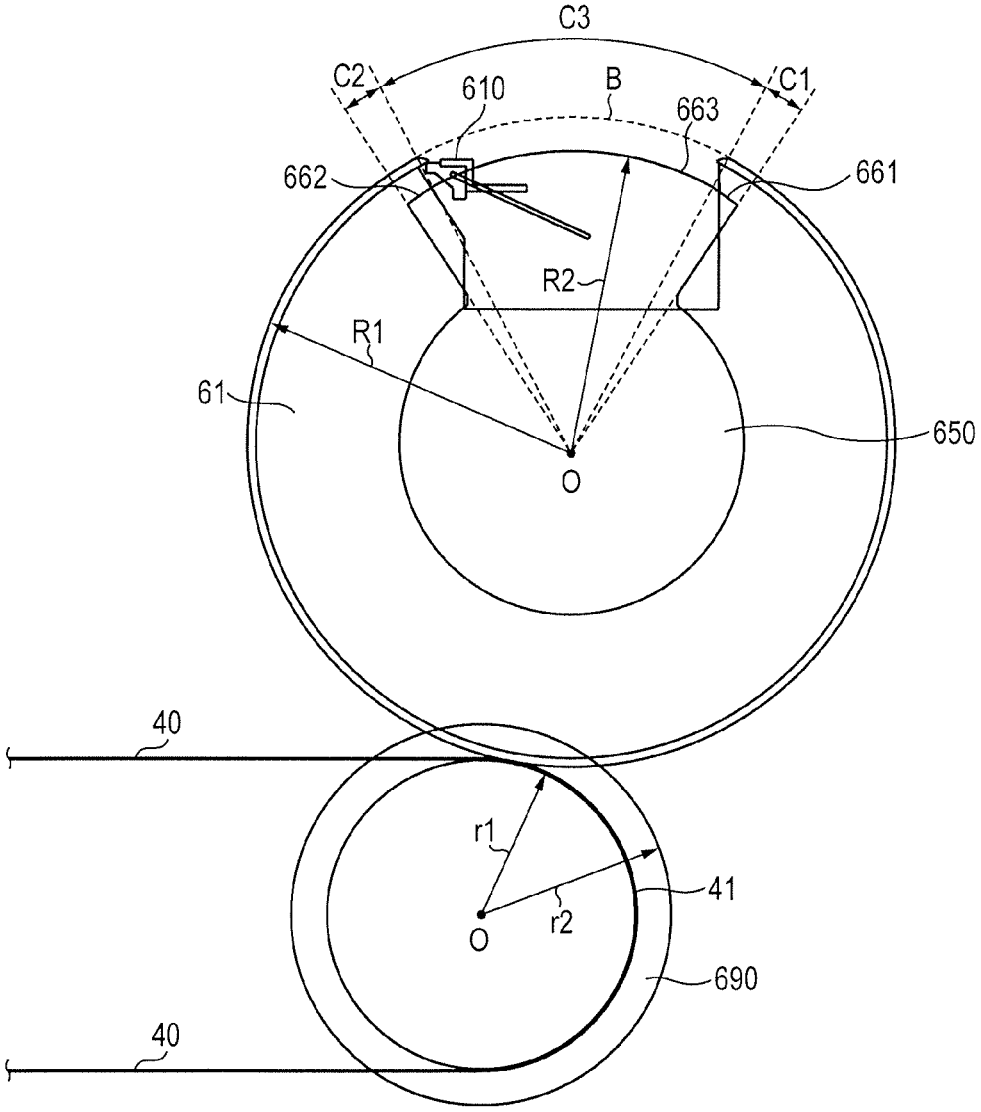
FIG. 7 is a diagram illustrating the secondary transfer roller in detail.

FIG. 7 shows configurations of the contact member and the support member according to an embodiment of the invention. The contact member 650 is provided with a contact surface 663 to which the distance is R2 from a rotation center O of the secondary transfer roller 61 in the shape as shown in the figure. On both sides of the contact surface 663, there are formed a first transport surface 661 for suppressing impact when the support member 690 of the belt driving roller 41 begins to come in contact with it and a second transport surface 662 for suppressing impact when the support member 690 is spaced apart therefrom.

The contact surface 663 is provided to correspond to a region (contact region C3) where the concaved portion 605 of the secondary transfer roller 61 is opened when seen from the roller axis direction. When the concaved portion 605 faces the belt driving roller 41 (or the transfer belt 40) according to the operation of the device, the contact surface 663 (or the contact region C3) comes in contact with the support member 690 of the belt driving roller 41 side, and thus the support member 690 receives the biasing pressure from the secondary transfer roller 61, thereby maintaining the distance and the positional relationship between the secondary transfer roller 61 and the belt driving roller 41.

In this embodiment, the sum of the radius R1 of the secondary transfer roller 61 and the radius r1 of the belt driving roller 41 is set to be substantially the same as the sum of the radius R2 to the contact surface 663 of the contact member 650 and the radius r2 of the support member 690. By this configuration, even when the concaved portion 605 of the secondary transfer roller 61 faces the belt driving roller 41, the contact member 650 comes in contact with the support member 690, and thus it is possible to maintain the positional relationship between the secondary transfer roller 61 and the belt driving roller 41 in the same manner as a case where a perimeter B of a virtual circumferential surface connecting both ends of the concaved portion 605 is provided.

In this embodiment, firstly, it is a first condition that the nip width formed when the secondary transfer roller 61 and the transfer belt 40 come in contact with each other is smaller than the width in the rotation direction of the concaved portion 605 of the secondary transfer roller 61, that is, the perimeter B of the virtual circumferential surface. Under the condition, it is possible to cause the state where the transfer belt 40 is spaced apart from the secondary transfer roller 61 during the rotation of the secondary transfer roller 61.

The transport interval between a current transfer material and a subsequently transported transfer material is set to be greater than the virtual perimeter B of the concaved portion 605 such that images on the transfer belt 40 are reliably transferred to a transfer material by the elastic member 607 installed on the surface of the secondary transfer roller 61.

Here, a method of measuring the nip width formed when the secondary transfer roller 61 comes in contact with the transfer belt 40 will be described. First, two-liquid cured silicon rubber for profiling is applied to a part forming a nip at the secondary transfer roller 61, and the silicon rubber is cured in a state of forming a nip portion between the belt driving roller 41 and the secondary transfer roller 61. In this embodiment, the injection type EXAFINE (made by GC Corporation) is used as the two-liquid cured silicon rubber. Next, the cured silicon rubber is drawn from the nip portion, and a width of the part forming the nip (the part where the silicon rubber is thinned) is measured using a vernier caliper.

The support member 690 is a member which has an outer circumference to which the distance is r2 from the roller rotation center O' of the belt driving roller 41, and is provided with a sliding portion such as a bearing or the like which lubricates and rotates a contact surface in order to suppress resistance at the time of contact with the contact member 650. In accordance with the rotation of each roller, the contact surface 663 of the contact member 650 comes in contact with the support member 690 which receives a load from the secondary transfer roller 61 biased by the biasing member 672, and the distance and the positional relationship between the secondary transfer roller 61 and the belt driving roller 41 are maintained.

The secondary transfer unit 60 sequentially repeats the state shown in FIG. 5 and the state shown in FIG. 6 in accordance with the rotation operations of the respective rollers. FIG. 5 shows the state where the concaved portion 605 does not face the belt driving roller 41 (or the transfer belt 40). At this time, a biasing force from the biasing member 672 is associated with the secondary transfer nip so as to secure a predetermined transfer pressure, and an appropriate transfer bias is applied between the secondary transfer roller 61 and belt driving roller 41. Thereby, toner particles on the transfer belt 40 are transferred to the transfer material side at the secondary transfer nip. In this state, the contact member 650 and the support member 690 are spaced completely apart from each other and thus a position limitation due to the contact member 650 and the support member 690 does not apply.

FIG. 6 shows the state where the concaved portion 605 faces the belt driving roller 41 (or the transfer belt 40). At this time, a contact surface 663 (contact region C3) of the contact member 650 comes in contact with the support member 690, and a biasing force of the secondary transfer roller 61 which is biased by the biasing member 672 is received by the support member 690 such that the distance and the positional relationship between the secondary transfer roller 61 and the belt driving roller 41 are maintained.

According to the embodiment described above, although the secondary transfer roller 61 is biased to the belt driving roller 41 side, since the shaft portion of the secondary transfer roller 61 is provided with the contact member 650, and the shaft portion of the belt driving roller 41 is provided with the support member 690, it is possible to maintain the positional relationship between the secondary transfer roller 61 and the belt driving roller 41 when the concaved portion 605 faces the transfer belt 40, that is, when the concaved portion 605 does not come in contact with the transfer belt 40.

Figure 8:
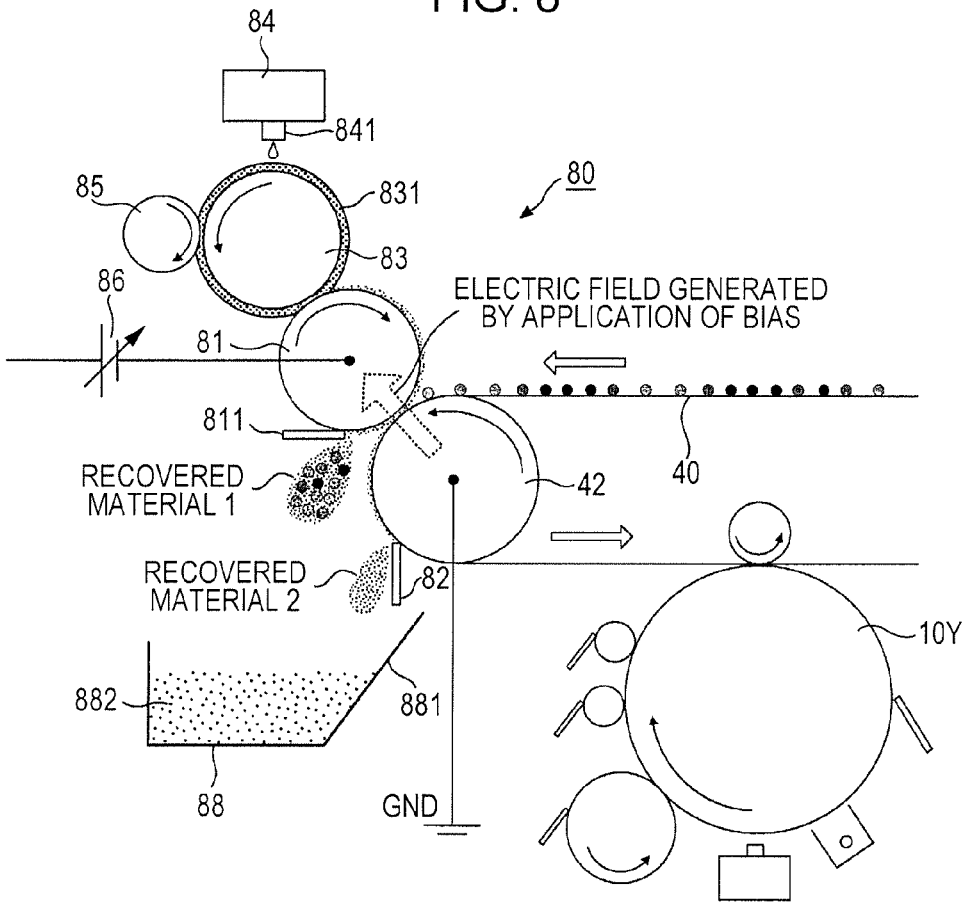
FIG. 8 is a diagram illustrating a main configuration of a cleaning device.

Next, the cleaning device 80 which cleans the surface of the transfer belt 40 will be described in more detail. FIG. 8 is a diagram illustrating an outline of the cleaning device usable in the image forming device according to an embodiment of the invention. In FIG. 8, the reference numeral 81 denotes a cleaning roller, the reference numeral 811 denotes a cleaning roller cleaning blade, the reference numeral 82 denotes a transfer member cleaning blade, the reference numeral 83 denotes an applying roller, the reference numeral 831 denotes a sponge outer circumferential portion, the reference numeral 85 denotes a leveling roller, the reference numeral 88 denotes a tank, the reference numeral 881 denotes a tank receiving portion, and the reference numeral 882 denotes a tank storage portion, respectively.

The cleaning roller 81 is arranged opposite to the tension roller 42 with the transfer belt 40 interposed therebetween, and comes in contact with the transfer belt 40 to clean the surface of the transfer belt 40. The cleaning roller 81 may use conductive urethane rubber as a base material, a surface layer of which is covered with conductive urethane coating so as to reduce the roughness of the surface.

The cleaning roller 81 is applied with a bias voltage by a bias application portion 86. In this embodiment, the cleaning roller 81 is applied with a predetermined voltage with a negative polarity and the tension roller 42 is grounded to generate an electric field between the cleaning roller 81 and the tension roller 42. Toner particles charged to a positive polarity are attracted toward the cleaning roller 81 side by the electric field, and the cleaning roller 81 can efficiently recover the toner particles on the transfer belt 40.

The bias application portion 86 in this embodiment can vary the bias applied to the cleaning roller 81 under the control of a controller and thus appropriately vary the bias depending on the state, the amount and the like of the toner particles on the transfer belt 40 to be cleaned. More specifically, it is possible to increase an electric field generated between the tension roller 42 and the cleaning roller 81 and to raise the recovery efficiency of the toner by setting a high absolute value of the bias applied to the cleaning roller 81 by the bias application portion 86.

The cleaning roller cleaning blade 811 is an elastic blade which has a rubber portion constituted by urethane rubber coming in contact with the surface of the cleaning roller 81, comes in contact with the cleaning roller 81, and performs the cleaning by scraping and dropping the toner particles and the carrier liquid on the cleaning roller 81. The recovered materials 1 scraped and dropped by the cleaning roller cleaning blade 811 include more toner particles than the recovered materials 2 recovered by a transfer belt cleaning blade 82 described later.

The recovered materials 1 scraped and dropped by the cleaning roller cleaning blade 811 fall down on the tank receiving portion 881 of the tank 88, and finally are stored in the tank storage portion 882.

The transfer belt cleaning blade 82 is arranged opposite to the tension roller 42 with the transfer belt 40 interposed therebetween. The transfer belt cleaning blade 82 is constituted by an elastic blade or the like which has a rubber portion formed of urethane rubber coming in contact with the surface of the transfer belt 40, and performs the cleaning by scraping and dropping the carrier liquid remaining on the transfer belt 40 which has been cleaned by the cleaning roller 81. Like the recovered materials 1, it is possible for the recovered materials 2 scraped and dropped by the transfer belt cleaning blade 82 to fall down onto the tank receiving portion 881 of the tank 88 and be stored in the tank storage portion 882.

The applying roller 83 is a roller which applies the carrier liquid to the cleaning roller 81, and is provided with a sponge member at the outer circumferential portion (sponge outer circumferential portion 831) in this embodiment. The cleaning roller 81 which has been applied with the carrier liquid by the applying roller 83 becomes wet, and the carrier liquid is sufficiently supplied to the nip portion between the cleaning roller 81 and the transfer belt 40 (tension roller 42). In this state, since the cleaning roller 81 is applied with the bias voltage for attracting the toner particles in the liquid developer, it is possible to obtain good cleaning characteristics.

Figure 9:
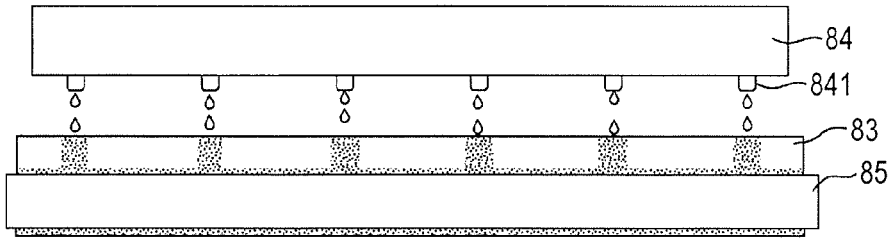
FIG. 9 is a schematic diagram illustrating an applying roller and a dropping device when seen from a direction perpendicular to an axial direction.

A dropping device 84 drops and supplies the carrier liquid to the applying roller 83 and is provided with a nozzle 841 in its lower portion, which discharges the carrier liquid. FIG. 9 is a schematic diagram of the applying roller 83, the dropping device 84, and the leveling roller 85 when seen from the direction perpendicular to the axial direction. The nozzles 841 of the dropping device 84 are disposed at a substantially uniform interval in the axial direction, and supply the carrier liquid to the applying roller 83 which is placed directly under it.

Figure 11:
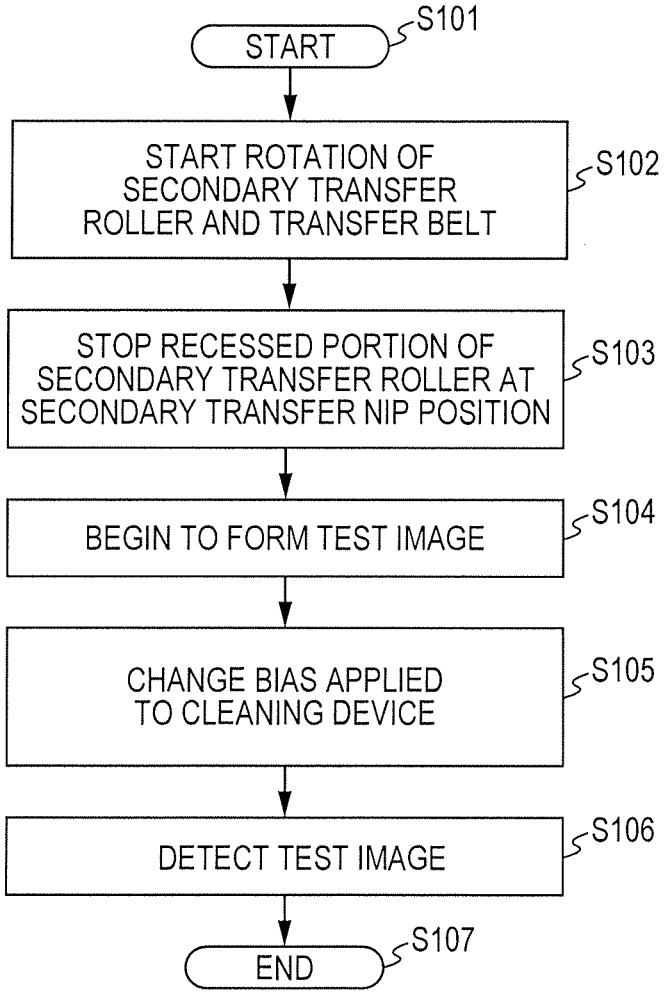
FIG. 11 is a flowchart illustrating an adjustment processing.

The applying roller 83 which has been supplied with the carrier liquid rotates towards the leveling roller 85 in the counterclockwise direction as shown in FIG. 11, the sponge outer circumferential portion 831 is pressed by the leveling roller 85, and thereby the carrier liquid in the sponge outer circumferential portion 831 becomes widely spread in the axial direction of the applying roller 83.

Figure 10:
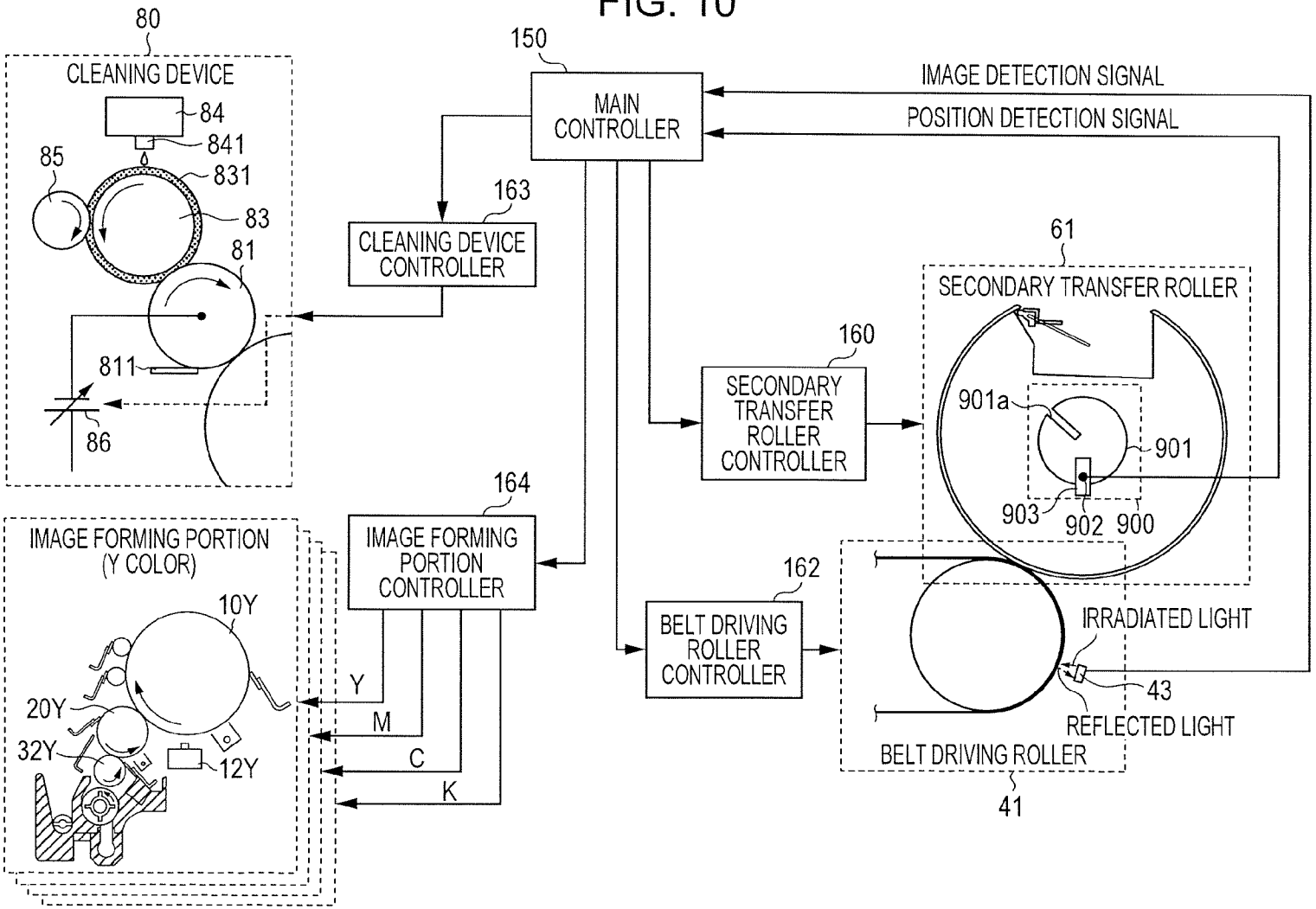
FIG. 10 is a block diagram illustrating a control in the image forming device.

A control in the image forming device according to an embodiment of the invention will now be described. FIG. 10 is a schematic diagram of a control block in the image forming device according to an embodiment of the invention. In FIG. 10, the reference numeral 150 denotes a main controller, the reference numeral 160 denotes a secondary transfer roller controller, the reference numeral 162 denotes a belt driving roller controller, the reference numeral 163 denotes a cleaning device controller, the reference numeral 164 denotes an image forming portion controller, the reference numeral 900 denotes a position detector, the reference numeral 901 denotes a detected member, the reference numeral 901*a* denotes a slit, the reference numeral 902 denotes a sensor, the reference numeral 903 denotes a sensor support member, and the reference numeral 43 denotes a detection sensor, respectively.

The main controller 150 controls the respective elements of the image forming device according to the embodiment of the invention. The main controller 150 may be implemented by using a general information processing device including a CPU or RAM, ROM, and the like and by storing programs which direct the CPU to output commands to a predetermined block based on input predetermined information stored in the ROM in advance.

The belt driving roller controller 162 controls, starting and stopping of rotation, and circumferential velocity of rotation, etc., for the belt driving roller 41, based on a control command from the main controller 150, and controls the movement of the transfer belt 40 wound on the belt driving roller 41.

The secondary transfer roller controller 160 controls circumferential velocity of rotation and so on for the secondary transfer roller 61, and operation timing of the gripping member 611 and operation timing of the transfer material peeling member 640 in the transfer material gripper 610, based on a control command from the main controller 150. In addition, a rotation reference position of the secondary transfer roller 61 detected by a rotation position detector is sent to the main controller 150 for use in various kinds of controls. The transfer material gripper 610 can vary a timing of gripping a transfer material or a timing of releasing a transfer material under the control of the secondary transfer roller controller 160.

The detection sensor 43 (detection portion) detects a state of a test image by irradiating light to the test image formed on the transfer belt 40 and sensing light reflected therefrom, and outputs an image detection signal to the main controller 150. In this embodiment, since the detection sensor 43 is installed at the part where the transfer belt 40 is wound and hung on the belt driving roller 41, the test image can be detected in the stable state without flopping of the transfer belt 40. The installment position of the detection sensor 43 is not limited to this embodiment but may be any appropriate position where the test image can be detected before being cleaned on the transfer belt 40.

The image forming portion controller 164 controls the respective color image forming portions constituted by the photoconductors 10, the development devices 30, and so forth. Specifically, the image forming portion controller 164 adjusts a state of toner images formed on the photoconductors 10 by controlling concentration of the liquid developers stored in the developer reservoirs 31, a charged state of the photoconductors by the corona charging devices 11, a development bias which is a voltage difference between the photoconductors 10 and the development rollers 20, and so on. In addition, it can adjust resist by controlling exposure timings in the exposure units 12 of the respective color image forming portions. In the adjustment processing using a test image in this embodiment, the adjustment is performed such that images formed by the image forming device become optimal based on the image detection signal output from the detection sensor 43.

The position detector 900 is a member which is installed for detecting a rotation position of the secondary transfer roller 61, detects a rotation reference position of the secondary transfer roller 61, and outputs a position detection signal to the main controller 150. In this embodiment, the position detector 900 includes the detected member 901, the slit 901*a*, the sensor 902, and the sensor support member 903.

The detected member 901 is fixed to the roller shaft portion 602 of the secondary transfer roller 61 and is a circular member which rotates along with the secondary transfer roller 61. The sensor 902 is fixed to the image forming device main body, and is installed so as to not rotate along with the secondary transfer roller 61. In the sensor 902, a light emitting portion and a light sensing portion are disposed opposite to each other with the detected member 901 interposed therebetween.

The slit 901*a* provided in the detected member 901 passes between the light emitting portion and the light sensing portion in accordance with the rotation of the secondary transfer roller 61, the light sensing portion enters an ON state where the light sensing portion senses light from the light emitting portion when the slit 901*a* passes therebetween, and the light sensing portion enters an OFF state when the slit 901*a* does not pass therebetween. In this embodiment, it is possible to detect a reference position of the secondary transfer roller 61 by a position detection signal output from the position detector 900 which uses such an optical system. The detection of the reference position is not necessarily performed by this aspect, but may be performed by a proper aspect, for example, by using a mechanical detection means or the like.

The cleaning device controller 163 controls the cleaning device 80 installed for cleaning the transfer belt 40, and, specifically, controls the rotation driving of the applying roller 83 and the cleaning roller 81, the amount of the carrier liquid dropped from the nozzle 841 of the dropping device 84, the amount of bias for the bias application portion 86, and so on. Particularly, in this embodiment, an absolute value of the bias added to the bias application portion 86 is controlled to be set greater upon cleaning than upon typical printing, and the toner remaining on the transfer belt 40 can be recovered efficiently.

Figure 12:
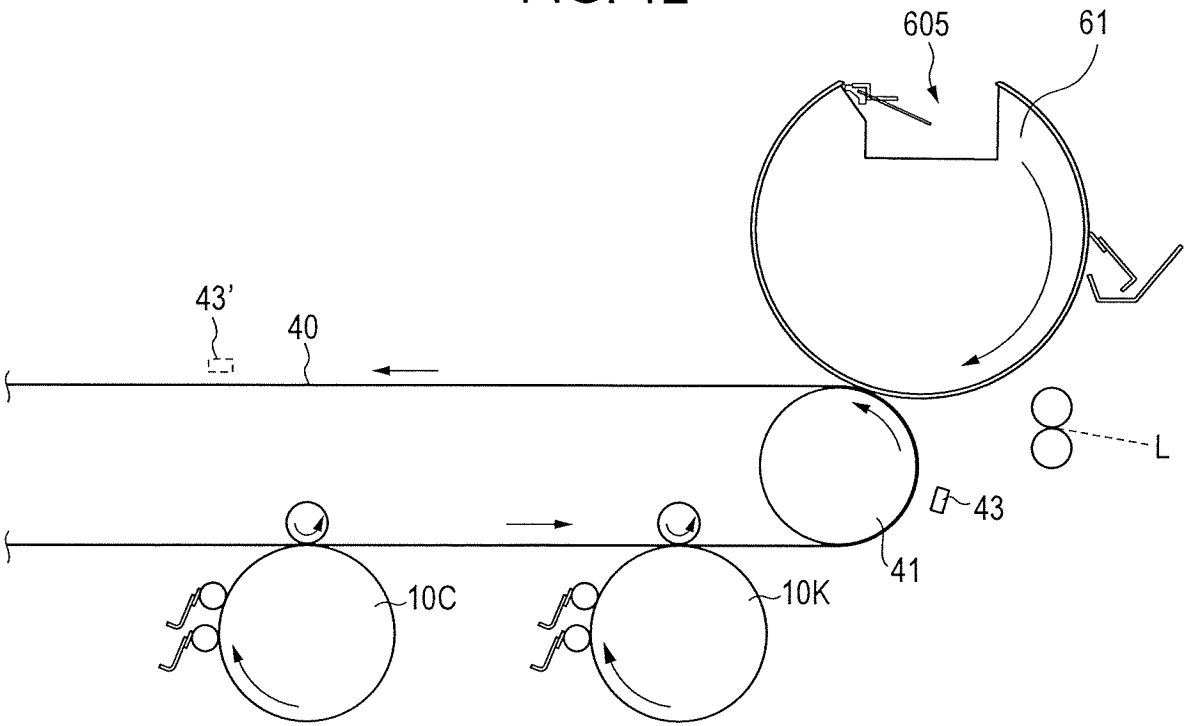
FIG. 12 is a diagram illustrating a state of the secondary transfer roller when the adjustment processing starts.
Figure 13:
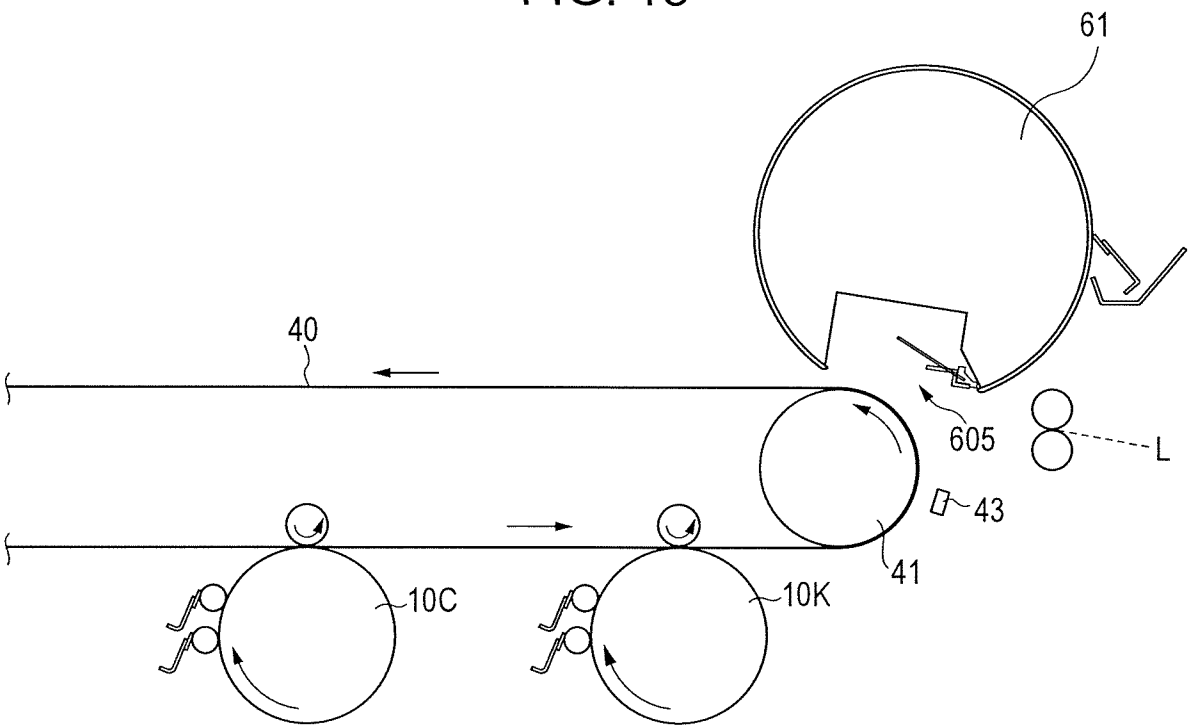
FIG. 13 is a diagram illustrating a state where an opening portion faces the transfer belt in the adjustment processing.
Figure 14:
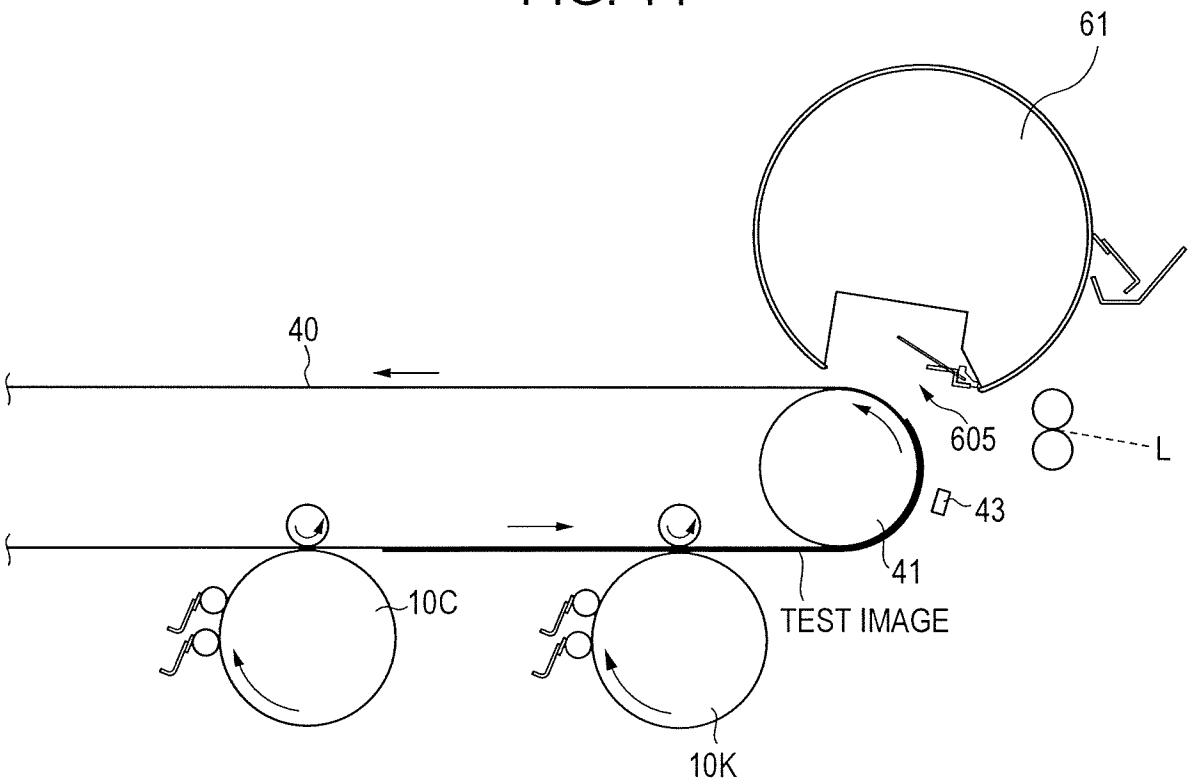
FIG. 14 is a diagram illustrating a state where a detection sensor detects a test image.

Next, the adjustment processing in which a test image is formed in this embodiment will be described in detail with reference to FIGS. 11 to 14. FIG. 11 is a flowchart illustrating a series of flows in the adjustment processing, FIG. 12 is a diagram illustrating a state of the secondary transfer roller when the adjustment processing begins, FIG. 13 is a diagram illustrating a state where an opening portion faces the transfer belt in the adjustment processing, and FIG. 14 is a diagram illustrating a state where the detection sensor detects a test image.

As shown in FIG. 11, at step S101, if the adjustment processing begins, first, the secondary transfer roller 61 and the transfer belt 40 start rotating. FIG. 12 shows a state of the secondary transfer roller 61 when the adjustment processing begins. In this figure, since the secondary transfer roller 61 and the transfer belt 40 come in contact with each other, first, the secondary transfer roller 61 and the transfer belt 40 rotate such that the concaved portion 605 of the secondary transfer roller 61 comes to a position where it faces the transfer belt 40. At this time, since the surfaces of the secondary transfer roller 61 and the transfer belt 40 are moved in the same direction at nearly the same velocity as in a typical printing, the surfaces of them can be protected. When the concaved portion of the secondary transfer roller 61 has already come to the position of facing the transfer belt 40 upon beginning of the adjustment processing, the rotation of the secondary transfer roller 61 may be omitted.

In this embodiment, the detection sensor 43 for detecting a test image is installed at a position where the transfer belt 40 is wound and hung on the belt driving roller 41. At this position, it is possible to detect a test image formed on the transfer belt 40 in the stable state without flopping of the transfer belt 40. In addition, the position of the detection sensor 43 is not limited thereto, but may be a position indicated by the reference numeral 43' in the figure.

At step S103, the concaved portion 605 of the secondary transfer roller 61 is stopped at a position of the secondary transfer nip, that is, a position where the concaved portion 605 faces the transfer belt 40 and the secondary transfer roller 61 is spaced apart from the transfer belt 40. The position where the secondary transfer roller 61 is stopped is determined based on the position detection signal indicating a reference position of the secondary transfer roller output from the position detector 900 as described in the block diagram of FIG. 10.

FIG. 13 shows a state where the secondary transfer roller 61 is stopped. As shown in this figure, the secondary transfer roller 61 and the transfer belt 40 are spaced completely apart from each other by the concaved portion 605 of the secondary transfer roller 61. This state is realized, as described with reference to FIG. 7, under the condition that the nip width formed by contact of the secondary transfer roller 61 and the transfer belt 40 is smaller than the width in the rotation direction of the concaved portion 605 of the secondary transfer roller 61, that is, the virtual perimeter B.

In this embodiment, as shown in FIG. 13, the secondary transfer roller 61 is stopped in the state of being spaced apart from the transfer belt 40, and thereafter a test image is formed. Since the secondary transfer roller 61 and the transfer belt 40 are spaced apart from each other, it is possible to prevent the secondary transfer roller 61 from being contaminated with a test image formed on the transfer belt 40.

FIG. 13 shows a state (S105) where after a test image is formed at step S104, it is carried on the transfer belt 40, and the test image is detected by the detection sensor 43. The detected test image is input to the control portions such as the main controller 150, the image forming portion controller 164, and the like, and the adjustment processing is performed such that the printing state becomes appropriate.

The test image is moved on the transfer belt 40 and cleaned by the cleaning device 80 described referring to FIG. 8. The test image contains lots of toner particles, and thus, unlike the cleaning of a typical transfer belt 40, cleaning capability may be raised by increasing the absolute value of bias applied to the bias application portion 86 when the test image passes through the cleaning device 80.

As described above, in this embodiment, it is possible to prevent the contamination of the secondary transfer roller 61 by spacing the secondary transfer roller 61 apart from the transfer belt 40 using the concaved portion 605 of the secondary transfer roller 61.

Figure 15:
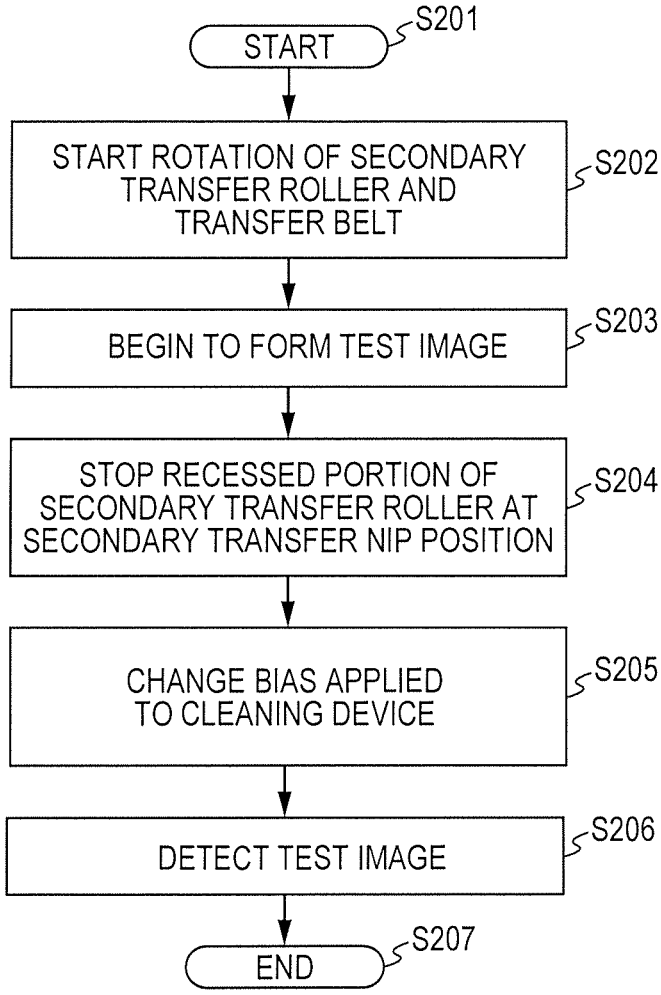
FIG. 15 is a flowchart illustrating an adjustment processing according to another embodiment.
Figure 16:
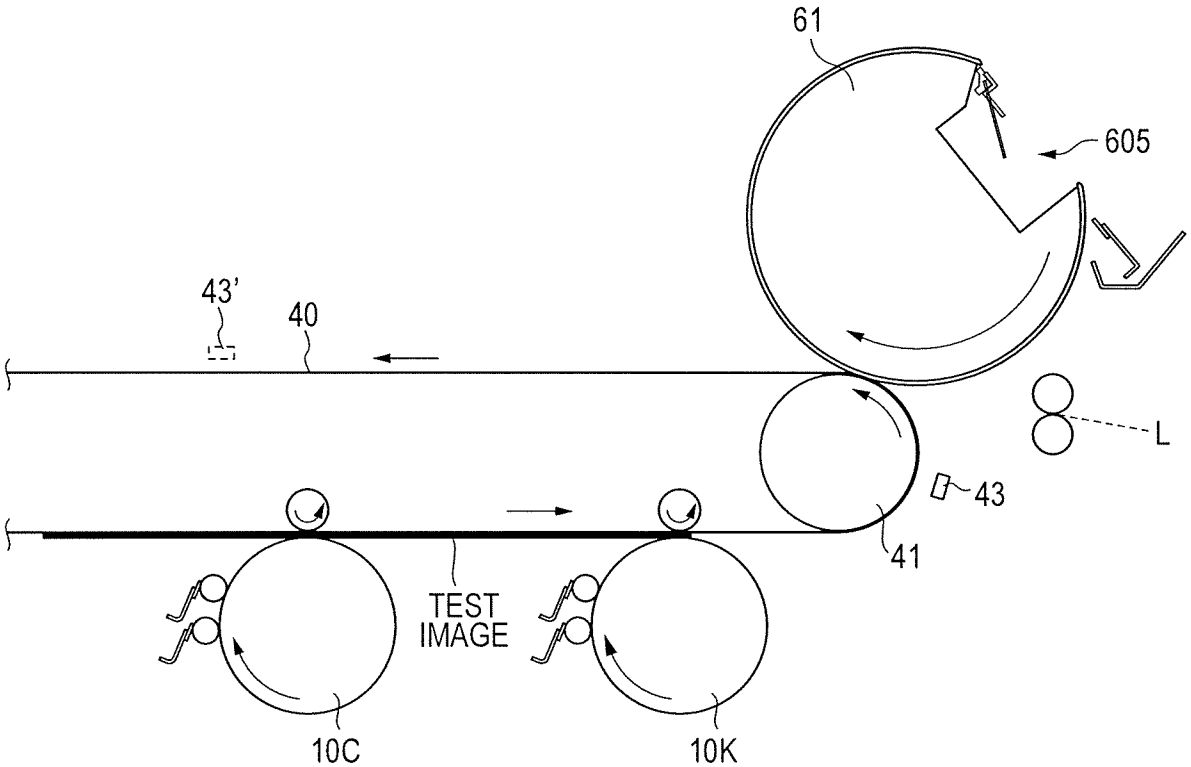
FIG. 16 is a diagram illustrating movement of a test image in a state where an open concaved portion faces a transfer belt.
Figure 17:
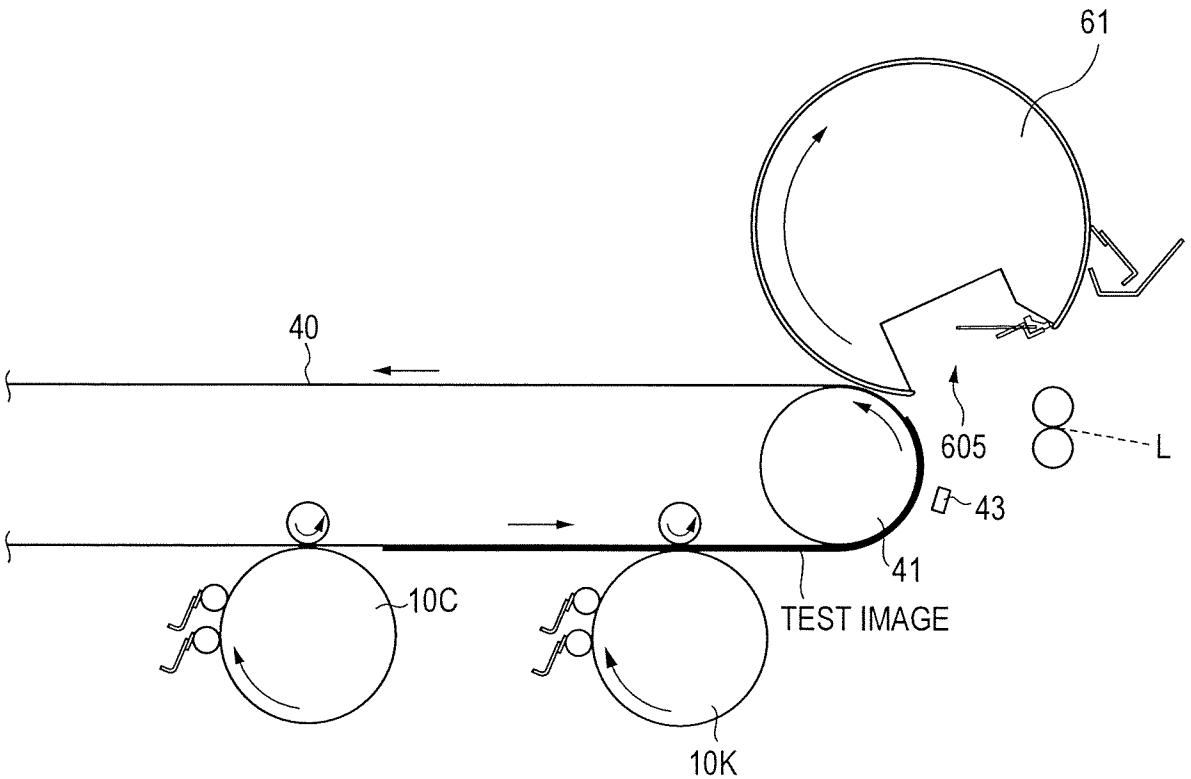
FIG. 17 is a diagram illustrating movement of the test image in the state where the open concaved portion faces the transfer belt.
Figure 18:
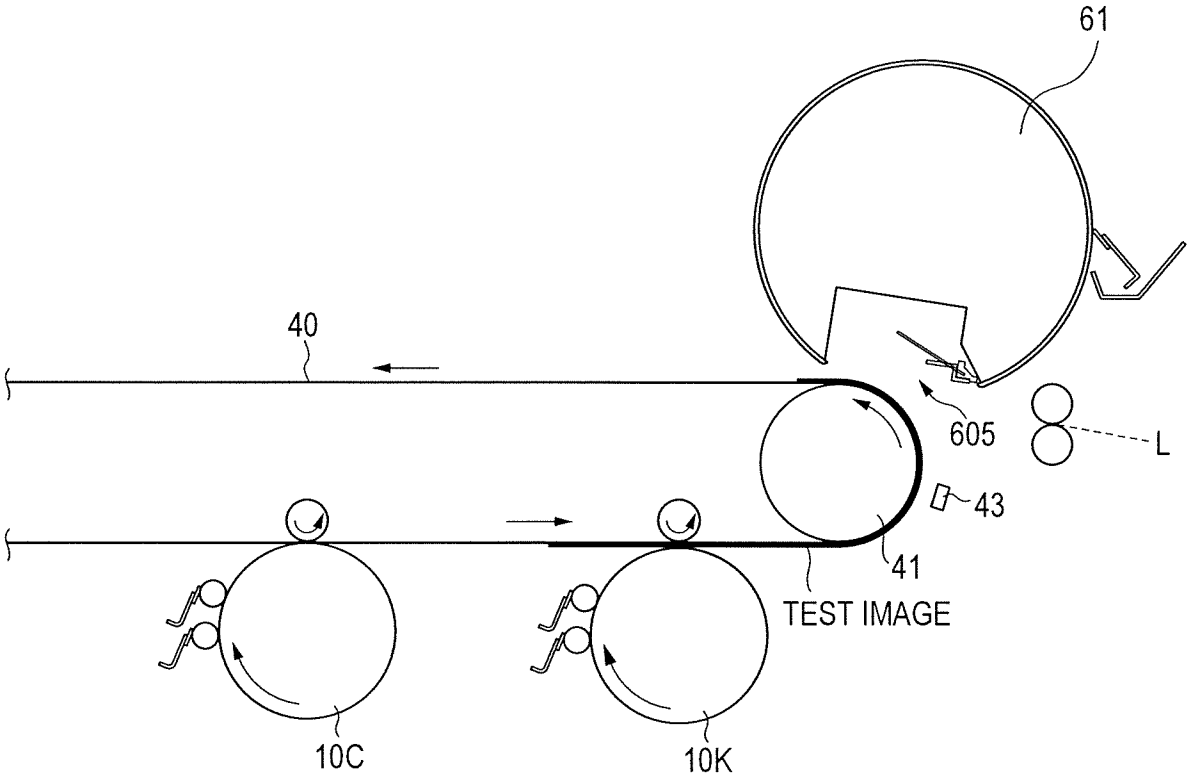
FIG. 18 is a diagram illustrating a state where the test image passes when the secondary transfer roller is stopped.

Another embodiment of the adjustment processing in which a test image is formed will now be described in detail with reference to FIGS. 15 to 18. FIG. 15 is a flowchart illustrating a series of flows in the adjustment processing, FIG. 16 is a diagram illustrating movement of a test image in a state where an open concaved portion faces a transfer belt, FIG. 17 is a diagram illustrating movement of the test image in the state where the open concaved portion faces the transfer belt, and FIG. 18 is a diagram illustrating a state where the test image passes while the secondary transfer roller is stopped.

This embodiment is different from the previous embodiment in which a test image is formed after the secondary transfer roller 61 is stopped in that a test image is formed while the secondary transfer roller 61 is rotating. As such, it is possible to decrease a time for the adjustment processing by simultaneously performing the rotation of the secondary transfer roller 61 and the formation of the test image.

In FIG. 15, if the adjustment processing starts, at step S202, the secondary transfer roller 61 and the transfer belt 40 begin to rotate. Next, at step S203, a test image begins to be formed. The processing at step S203 is performed without waiting for the concaved portion 605 of the secondary transfer roller 61 to be stopped at the position of facing the transfer belt 40. FIG. 16 shows this state, and the test image formed on the transfer belt 40 is transported to the secondary transfer nip; however, at this time, the concaved portion 605 does not face the transfer belt 40.

At step S204, the concaved portion 605 of the secondary transfer roller 61 is stopped at the secondary transfer nip position. This processing is the same as the processing at step S103 in the previous embodiment, and whether or not the secondary transfer nip position has been reached is determined based on the position detection signal output from the position detector 900. FIG. 17 shows a state immediately before the concaved portion 605 of the secondary transfer roller 61 faces the transfer belt 40. Further rotation progresses from this state, and the concaved portion 605 of the secondary transfer roller 61 comes to the position of facing the transfer belt 40 as shown in FIG. 18. In other words, while the secondary transfer roller 61 enters the state of being spaced apart from the transfer belt 40, the secondary transfer roller 61 stops rotating.

In this embodiment, when the test image reaches the secondary transfer nip, it is necessary for the secondary transfer roller 61 to lie in the state of being spaced apart from the transfer belt 40. Therefore, the timing of starting forming the test image may be synchronized with the rotation position of the secondary transfer roller 61, and the timing of starting forming the test image may be decided using the rotation position detection of the secondary transfer roller 61 by the position detector 900.

As described above, in this embodiment, since the test image is formed while the secondary transfer roller 61 rotates, it is possible to decrease a time for the adjustment processing. The cleaning of the transfer belt 40, the detection of the test image, and so forth which are not described in this embodiment are the same as those in the previous embodiment.

FIG. 11 is a diagram illustrating test images formed on the transfer belt 40. In this embodiment, although the adjustment processing can be performed by forming test images in a typical printing, the adjustment processing may be performed only in order to form test images. In the figure, it can be seen that test images between images P1 and P2 and images P1 and P2 which are used in a typical printing are formed on the transfer belt 40, that is, transferred to a transfer material. The images P1 and P2 and the test images are all toner images which are transferred onto the transfer belt 40 from the photoconductors 10 of the respective colors.

In this embodiment, the detection sensor 43 for detecting a test image is installed at a position where the transfer belt 40 is wound and hung on the belt driving roller 41. At this position, it is possible to detect a test image formed on the transfer belt 40 in the stable state without flopping of the transfer belt 40. In addition, the position of the detection sensor 43 is not limited thereto, but may be a position indicated by the reference numeral 43' in the figure.

In the test image formed on the transfer belt 40, the length thereof along the movement direction of the transfer belt 40 is designated as D. The length D of the test image is shorter than the virtual perimeter B of the concaved portion 605 of the secondary transfer roller 61. By selecting the test image to have such a length, it is possible to limit the test image within the concaved portion 605 when the test image is moved around the secondary transfer portion, and the test image is not attached to the secondary transfer roller 61.

FIG. 12 shows a state where the movement of the transfer belt 40 and the rotation of the secondary transfer roller 61 further progress from the state in FIG. 11, and shows a state where the test image is inserted into the concaved portion 605. The test image 1 detected by the detection sensor 43 is carried on the transfer belt 40 and inserted into the concaved portion 605 of the secondary transfer roller 61. The front end portion of the test image 1 is positioned around one end of the concaved portion 605 which is being spaced apart therefrom and thus is not attached to the secondary transfer roller 61. In order to form such a test image, accurate timing of forming the test image is required. For this reason, in this embodiment, the timing of forming the test image is determined using the rotation position of the secondary transfer roller 61 detected by the position detector 900 described referring to FIG. 11.

FIG. 13 shows a state where the movement of the transfer belt 40 and the rotation of the secondary transfer roller 61 further progress from the state in FIG. 12, and shows a state where the test image passes through the concaved portion 605. The rear end portion of the test image 1 is positioned around the other end portion of the concaved portion 605 which is being spaced apart therefrom and thus is not attached to the secondary transfer roller 61. As such, the length D of the test image is shorter than the virtual perimeter B of the concaved portion 605 and the timing of forming the test image is appropriately determined. Thereby, it is possible to prevent the secondary transfer roller 61 from being contaminated with the test image by passing the test image through the concaved portion 605.

The test image is moved on the transfer belt 40 and cleaned by the cleaning device 80 described referring to FIG. 8. The test image contains lots of toner particles, and thus, unlike the cleaning of a typical transfer belt 40, cleaning capability may be raised by increasing the absolute value of bias applied to the bias application portion 86 when the test image passes through the cleaning device 80.

FIG. 13 shows a state where the image P2, the test image 2, and the image P3 are formed on the transfer belt 40 following the test image 1. The images P2 and P3 used in a typical printing are transferred to a transfer material; however, the test image 2 is not transferred to a transfer material like the test image 1, not attached to the secondary transfer roller 61, carried by the transfer belt 40, and cleaned by the cleaning device 80. The length L in the movement direction of the transfer belt 40 from the front end portion of the test image 1 to the front end portion of the test image 2 is nearly the same as the movement distance in the circumferential direction when the secondary transfer roller 61 rotates once. By selecting such a distance, it is possible to form a test image for each rotation of the secondary transfer roller 61.

As described above, in this embodiment, by using the concaved portion 605 of the secondary transfer roller 61, it is possible to optimize the image forming device during the formation of test images in a typical printing. In addition, the length D of the test image is shorter than the virtual perimeter B of the concaved portion 605 and the timing of forming the test image is appropriately determined. Thereby, it is possible to prevent the secondary transfer roller 61 from being contaminated with the test image by passing the test image through the concaved portion 605.

Figure 19:
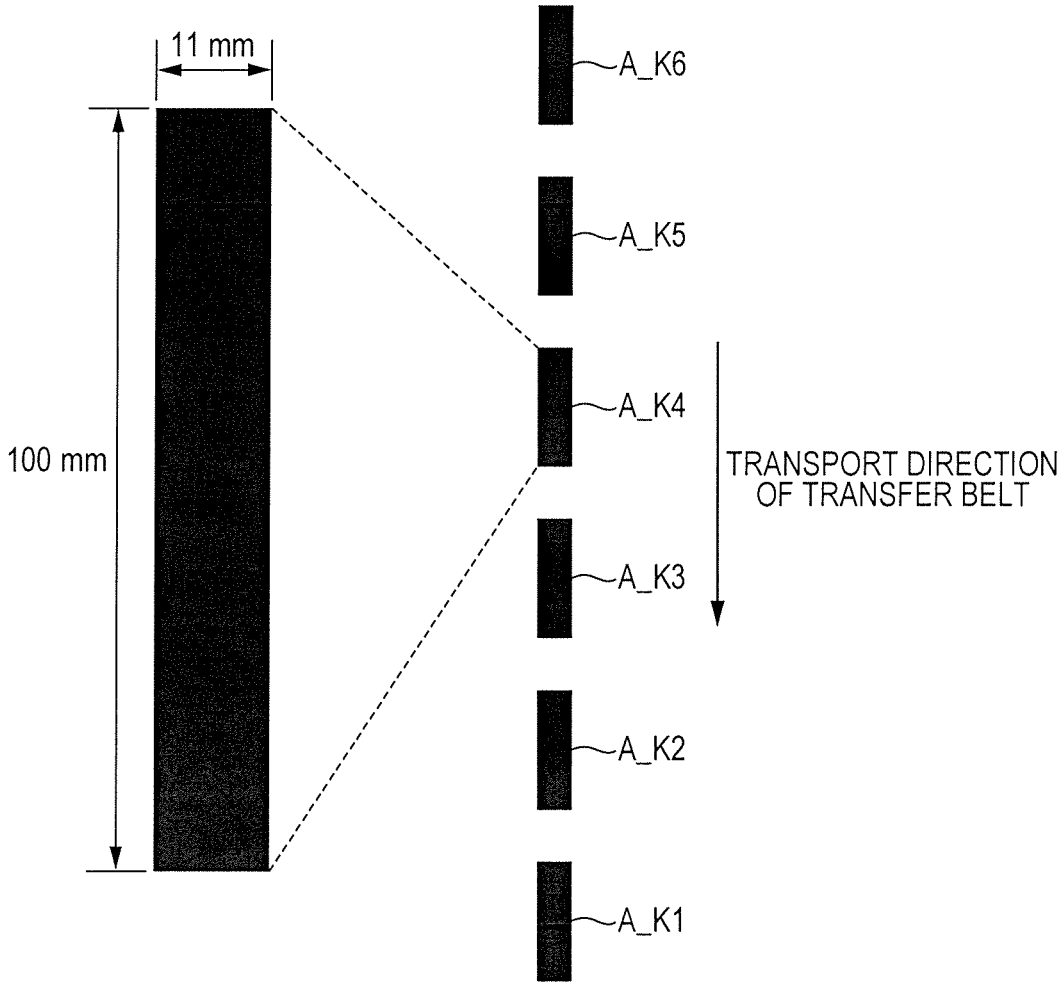
FIG. 19 is a diagram illustrating an example of a test image (development patch).

Next, various embodiments of test images will be described with reference to FIGS. 19 to 22. FIG. 19 is a diagram illustrating an example of a test image (development patch) used to adjust development bias or concentration of a liquid developer. Six solid images are formed along the movement direction of the transfer belt 40. The six solid images are all solid images of K color, and conditions of forming the solid images in the image forming portion are different from each other. The image forming portion can be appropriately adjusted by detecting the solid images having the different conditions using the detection sensor 43. In the same manner for other colors of Y, M, and C, six solid images are respectively formed, and the image forming portions of the respective colors are appropriately adjusted.

Figure 20:
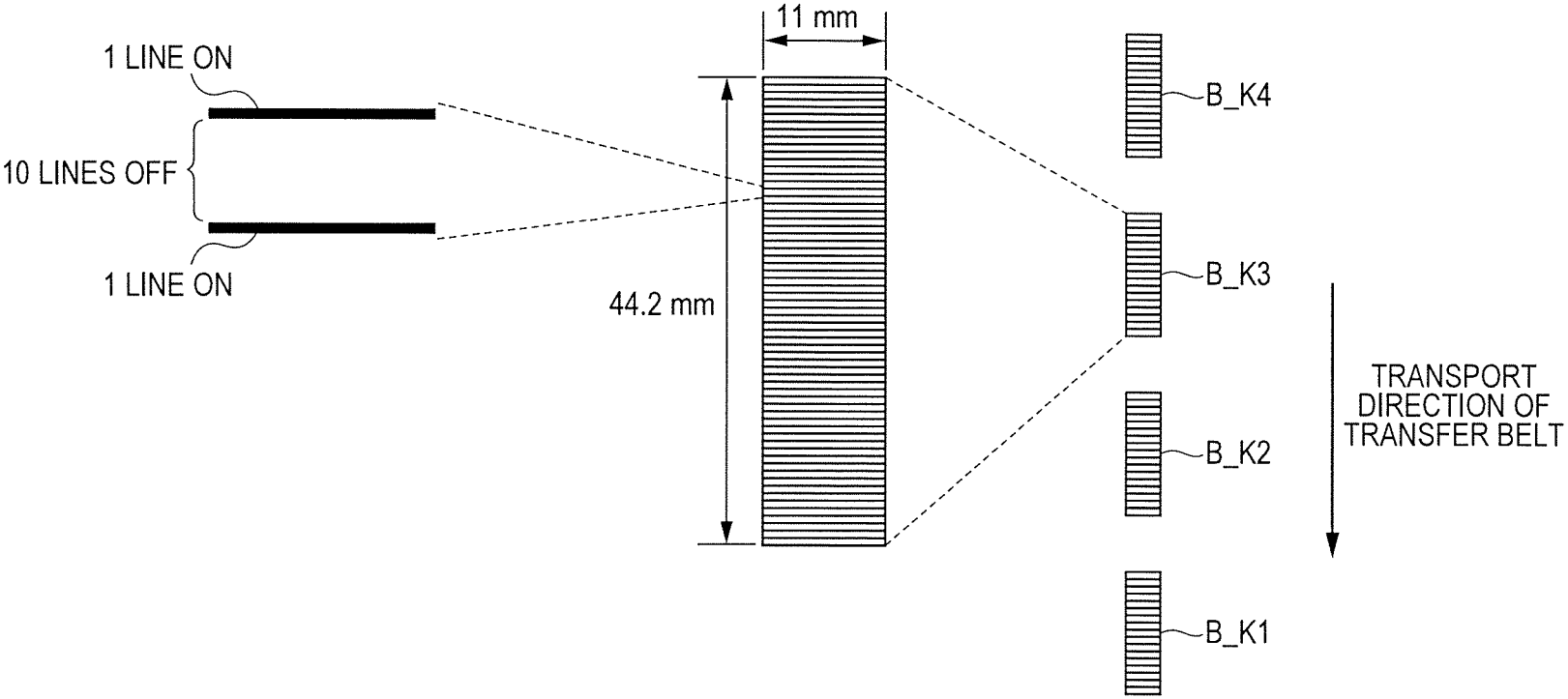
FIG. 20 is a diagram illustrating an example of a test image (exposure patch).

FIG. 20 is a diagram illustrating an example of a test image (exposure patch) used to measure a resolution of an image to be formed. Exposure intensity or charging potential for the photoconductors 10 in the image forming portion is adjusted by forming a test image and detecting it using the detection sensor 43. Four images are formed along the movement direction of the transfer belt 40. The four images are all sets of thin lines formed of K color. In the same manner for other colors of Y, M, and C, four solid images are respectively formed, and the image forming portions of the respective colors are appropriately adjusted.

Figure 21:
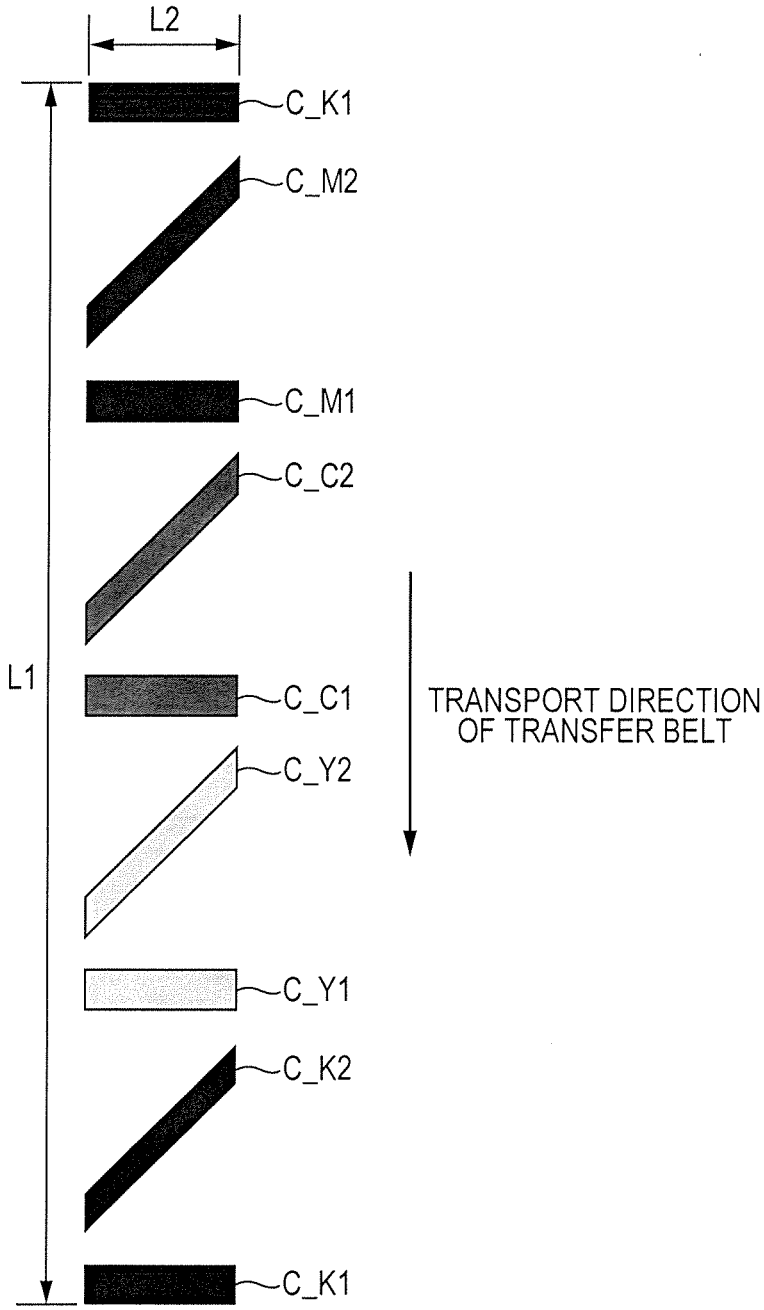
FIG. 21 is a diagram illustrating an example of a test image (resist pattern).

FIG. 21 is a diagram illustrating an example of a test image (resist pattern) used to correct a shift of exposure timings of images to be formed, or misalignment of images formed by the image forming portions of the respective colors. There are shown nine solid images which are sequentially arranged from the upstream of the transport direction of the transfer belt 40.

In the subscripts K1, K2, Y1, Y2, C1, C2, M1, and M2 added to the respective solid images, the letters indicate colors of the formed solid images, and the numbers indicate the shapes of the solid images. The first shape of the solid image has a rectangular shape perpendicular to the transport direction of the transfer belt 40, and the shape of the second solid image has a rectangular shape with a predetermined tilted angle with respect to the transport direction of the transfer belt 40. The misalignment in the main scanning direction (the transverse direction in the figure) is measured as a distance between the first solid image and the second solid image of the same color which are adjacent to each other. Also, the misalignment in the sub-scanning direction (longitudinal direction in the figure) is measured by a distance between the first solid images of different colors.

Figure 22:
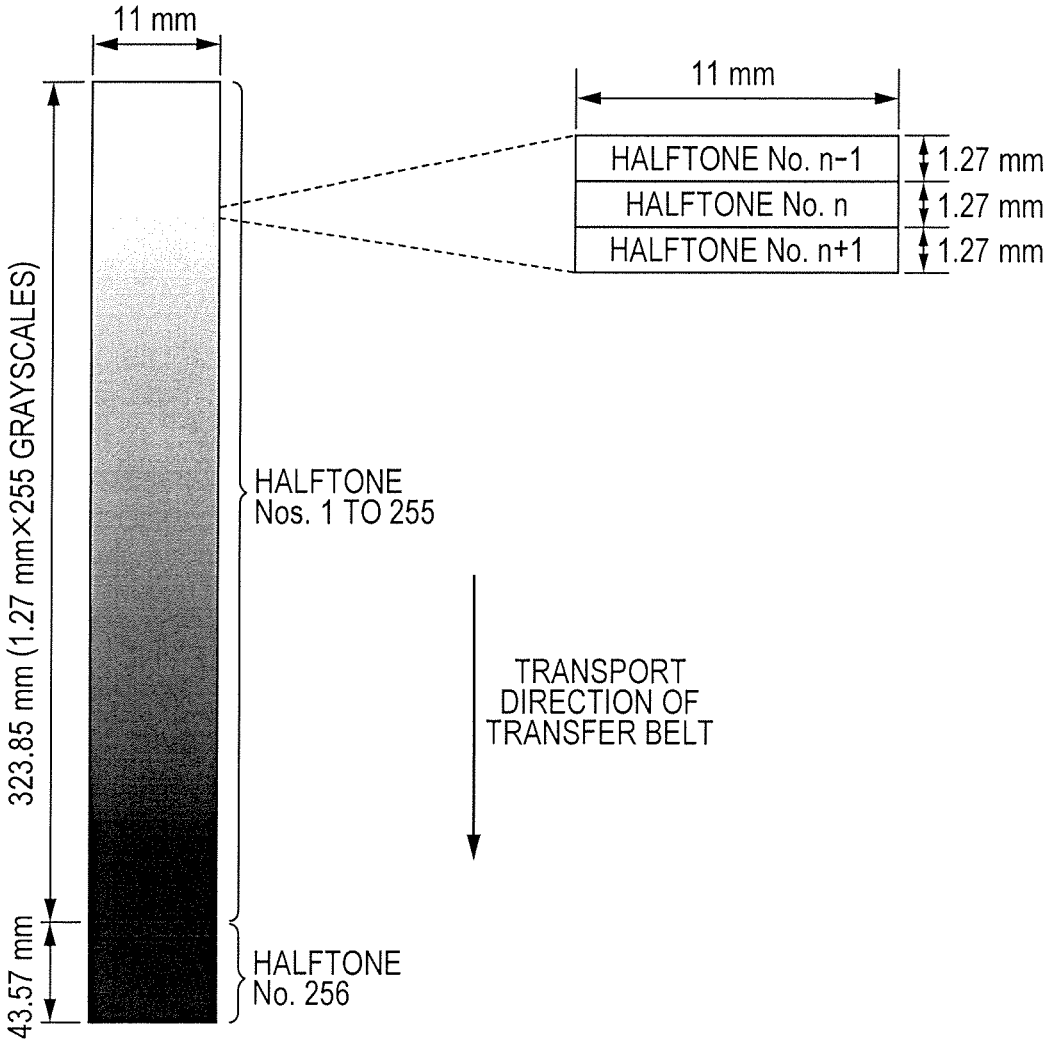
FIG. 22 is a diagram illustrating an example of a test image (grayscale patch).

FIG. 22 is a diagram illustrating an example of a test image (grayscale patch) used to measure a grayscale degree of an image to be formed. The γ table for image data is adjusted by forming such a test image which is detected by the detection sensor 43. In this embodiment, the image has a region of which the length in the transport direction of the transfer belt 40 is 43.57 mm and which has the halftone No. 256 (solid image) in the leading portion. Also, subsequent to the region, the image has regions of which the lengths in the transport direction of the transfer belt 40 are each 1.27 mm and the halftone Nos. are sequentially reduced by one.

Although various embodiments have been described in this specification, embodiments constituted by properly combining the configurations in the respective embodiments also lie within the scope of the invention.

The entire disclosure of Japanese Patent Application No: 2009-261886, filed Nov. 17, 2009 is expressly incorporated by reference herein.

What is claimed is:

1. An image forming method comprising:

rotating a transfer roller that forms a transfer nip by contacting with a transfer belt and has a concaved portion wider than the transfer nip in a rotation direction;

stopping rotation of the transfer roller at a position where the transfer belt faces the concaved portion of the transfer roller and the transfer belt and the transfer roller are spaced apart from each other;

moving the transfer belt while the transfer roller is stopped, and transferring an image formed on an image carrier to the transfer belt; and detecting the transferred image by a detection portion.

2. The image forming method according to claim 1, wherein the image transferred to the transfer belt is cleaned by a cleaning roller that contacts with the transfer belt and is applied with a bias, while the transfer roller is stopped.

3. An image forming device comprising:

an image carrier that carries an image;

a transfer belt to which an image carried on the image carrier is transferred;

a transfer roller that forms a transfer nip by a circumferential surface contacting with the transfer belt and has a concaved portion wider than the transfer nip in a rotation direction in the circumferential surface;

a controller that enables the transfer roller to stop rotating at a position where the concaved portion of the transfer roller faces the transfer belt and the transfer roller is spaced apart from the transfer belt, the transfer belt to be moved while the transfer roller stops rotating, and the image carried on the image carrier to be transferred to the transfer belt; and a detection portion that detects the image transferred to the transfer belt.

4. The image forming device according to claim 3, further comprising a cleaning portion that cleans the transfer belt, wherein the controller enables the cleaning portion to clean the image transferred to the transfer belt while the transfer roller stops rotating.

5. The image forming device according to claim 4, wherein the cleaning portion is a cleaning roller that contacts with the transfer belt and is applied with a bias, and wherein the controller enables the cleaning roller to be applied with a bias while the transfer roller stops rotating.

6. The image forming device according to claim 3, wherein the concaved portion of the transfer roller is provided with a gripping portion that grips a transfer material.

* * * * *